US008517828B2

(12) United States Patent
Dewaal et al.

(10) Patent No.: US 8,517,828 B2
(45) **Date of Patent: *Aug. 27, 2013**

(54) GAMING SYSTEM AND METHOD FOR PROVIDING MULTI-LEVEL PERSONAL PROGRESSIVE AWARDS

(75) Inventors: Daniel Dewaal, Reno, NV (US); Vincent Smith, Las Vegas, NV (US); Lance R. Peterson, Reno, NV (US); Hans Elias, Reno, NV (US)

(73) Assignee: IGT, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/443,578

(22) Filed: Apr. 10, 2012

(65) Prior Publication Data

US 2012/0196673 A1 Aug. 2, 2012

Related U.S. Application Data

(63) Continuation of application No. 11/927,029, filed on Oct. 29, 2007, now Pat. No. 8,197,337.

(51) Int. Cl.
*A63F 9/24* (2006.01)

(52) U.S. Cl.
USPC ..... 463/27

(58) Field of Classification Search
USPC ..... 463/27
See application file for complete search history.

(56) References Cited

U.S. PATENT DOCUMENTS

| | | | |
|---|---|---|---|
| 4,856,787 | A | 8/1989 | Itkis |
| 5,116,055 | A | 5/1992 | Tracy |
| 5,158,293 | A | 10/1992 | Mullins |
| 5,275,400 | A | 1/1994 | Weingardt |
| 5,280,909 | A | 1/1994 | Tracy |
| 5,292,127 | A | 3/1994 | Kelly et al. |
| 5,324,035 | A | 6/1994 | Morris et al. |
| 5,326,104 | A | 7/1994 | Pease et al. |
| 5,344,144 | A | 9/1994 | Canon |
| 5,423,539 | A | 6/1995 | Nagao |

(Continued)

FOREIGN PATENT DOCUMENTS

| | | |
|---|---|---|
| AU | 711501 | 10/1999 |
| GB | 2 137 392 A | 10/1984 |

(Continued)

OTHER PUBLICATIONS

Excerpt from Local Area Electronic Gaming Machine Communications Protocol, QCOM Version 1.5, by Queensland Treasury Office of Gaming Regulation printed Feb. 26, 1998.

Fast Buck Systems Manual, written by International Game Technology, available to Mirage shift supervisors at least as early as May 30, 1990.

(Continued)

*Primary Examiner* — Corbett B Coburn

(74) *Attorney, Agent, or Firm* — Neal, Gerber & Eisenberg LLP

(57) ABSTRACT

A gaming system and method including at least one gaming system progressive award adapted to be provided to any player at one of a plurality of the gaming machines. The gaming system progressive award is associated with a designated quantity of points wherein the first player at one of the gaming devices to accumulate the designated quantity of points is provided the gaming system progressive award. The gaming system and method also includes, for each of a plurality of players, a plurality of personal progressive awards arranged in a personal multi-level progressive configuration. Such personal progressive awards are individual to each specific player and funded by that player's wagers placed at the gaming devices in the gaming system.

18 Claims, 16 Drawing Sheets

(56) References Cited

U.S. PATENT DOCUMENTS

| | | | |
|---|---|---|---|
| 5,472,194 | A | 12/1995 | Breeding et al. |
| 5,476,259 | A | 12/1995 | Weingardt |
| 5,536,016 | A | 7/1996 | Thompson |
| 5,560,603 | A | 10/1996 | Seeling et al. |
| 5,580,309 | A | 12/1996 | Piechowiak |
| 5,611,730 | A | 3/1997 | Weiss |
| 5,613,912 | A | 3/1997 | Slater |
| 5,655,961 | A | 8/1997 | Acres et al. |
| 5,702,304 | A | 12/1997 | Acres et al. |
| 5,741,183 | A | 4/1998 | Acres et al. |
| 5,743,523 | A | 4/1998 | Kelly et al. |
| 5,752,882 | A | 5/1998 | Acres et al. |
| 5,761,647 | A | 6/1998 | Boushy |
| 5,766,076 | A | 6/1998 | Pease et al. |
| 5,769,716 | A | 6/1998 | Saffari et al. |
| 5,770,533 | A | 6/1998 | Franchi |
| RE35,864 | E | 7/1998 | Weingardt |
| 5,779,549 | A | 7/1998 | Walker et al. |
| 5,816,918 | A | 10/1998 | Kelly et al. |
| 5,820,459 | A | 10/1998 | Acres et al. |
| 5,833,540 | A | 11/1998 | Miodunski et al. |
| 5,836,817 | A | 11/1998 | Acres et al. |
| 5,851,148 | A | 12/1998 | Brune et al. |
| 5,851,149 | A | 12/1998 | Xidos et al. |
| 5,855,515 | A | 1/1999 | Pease et al. |
| 5,876,284 | A | 3/1999 | Acres et al. |
| 5,885,158 | A | 3/1999 | Torango et al. |
| 5,919,091 | A | 7/1999 | Bell et al. |
| 5,947,820 | A | 9/1999 | Morro et al. |
| 5,997,400 | A | 12/1999 | Seelig et al. |
| 6,001,016 | A | 12/1999 | Walker et al. |
| 6,012,982 | A | 1/2000 | Piechowiak et al. |
| 6,012,983 | A | 1/2000 | Walker et al. |
| 6,059,289 | A | 5/2000 | Vancura |
| 6,089,980 | A | 7/2000 | Gauselmann |
| 6,099,408 | A | 8/2000 | Schneier et al. |
| 6,110,041 | A | 8/2000 | Walker et al. |
| 6,135,884 | A | 10/2000 | Hedrick et al. |
| 6,142,872 | A | 11/2000 | Walker et al. |
| 6,159,098 | A | 12/2000 | Slomiany et al. |
| 6,162,121 | A | 12/2000 | Morro et al. |
| 6,162,122 | A | 12/2000 | Acres et al. |
| 6,168,520 | B1 | 1/2001 | Baerlocher et al. |
| 6,186,894 | B1 | 2/2001 | Mayeroff |
| 6,190,255 | B1 | 2/2001 | Thomas et al. |
| 6,203,010 | B1 | 3/2001 | Jorasch et al. |
| 6,203,430 | B1 | 3/2001 | Walker et al. |
| 6,210,276 | B1 | 4/2001 | Mullins |
| 6,224,483 | B1 | 5/2001 | Mayeroff |
| 6,231,445 | B1 | 5/2001 | Acres |
| 6,241,608 | B1 | 6/2001 | Torango |
| 6,244,958 | B1 | 6/2001 | Acres |
| 6,254,483 | B1 | 7/2001 | Acres |
| 6,257,981 | B1 | 7/2001 | Acres et al. |
| RE37,414 | E | 10/2001 | Harlick |
| 6,302,793 | B1 | 10/2001 | Fertitta, III et al. |
| 6,312,333 | B1 | 11/2001 | Acres |
| 6,319,125 | B1 | 11/2001 | Acres |
| 6,328,649 | B1 | 12/2001 | Randall et al. |
| 6,336,857 | B1 | 1/2002 | McBride |
| 6,364,768 | B1 | 4/2002 | Acres et al. |
| 6,371,852 | B1 | 4/2002 | Acres |
| 6,375,187 | B1 | 4/2002 | Baerlocher |
| 6,375,567 | B1 | 4/2002 | Acres |
| 6,375,569 | B1 | 4/2002 | Acres |
| 6,431,983 | B2 | 8/2002 | Acres |
| 6,435,968 | B1 | 8/2002 | Torango |
| RE37,885 | E | 10/2002 | Acres et al. |
| 6,506,118 | B1 | 1/2003 | Baerlocher et al. |
| 6,514,141 | B1 | 2/2003 | Kaminkow et al. |
| 6,565,434 | B1 | 5/2003 | Acres |
| 6,569,615 | B1 | 5/2003 | Thatte et al. |
| 6,589,115 | B2 | 7/2003 | Walker et al. |
| 6,599,192 | B1 | 7/2003 | Baerlocher et al. |
| 6,599,193 | B2 | 7/2003 | Baerlocher et al. |
| 6,607,438 | B2 | 8/2003 | Baerlocher et al. |
| 6,626,758 | B1 | 9/2003 | Parham et al. |
| 6,632,141 | B2 | 10/2003 | Webb et al. |
| 6,648,754 | B2 | 11/2003 | Baerlocher et al. |
| 6,656,052 | B2 | 12/2003 | Abramopoulos et al. |
| 6,712,697 | B2 | 3/2004 | Acres |
| 6,726,563 | B1 | 4/2004 | Baerlocher et al. |
| 6,776,715 | B2 | 8/2004 | Price |
| 6,786,819 | B2 | 9/2004 | Baerlocher et al. |
| 6,800,030 | B2 | 10/2004 | Acres |
| 6,808,454 | B2 | 10/2004 | Gerrard et al. |
| 6,811,483 | B1 | 11/2004 | Webb et al. |
| 6,814,664 | B2 | 11/2004 | Baerlocher et al. |
| 6,832,958 | B2 | 12/2004 | Acres et al. |
| 6,869,361 | B2 | 3/2005 | Sharpless et al. |
| 6,887,154 | B1 | 5/2005 | Luciano, Jr. et al. |
| 6,890,257 | B2 | 5/2005 | Baerlocher |
| 6,899,625 | B2 | 5/2005 | Luciano, Jr. et al. |
| 6,908,387 | B2 | 6/2005 | Hedrick et al. |
| 6,910,964 | B2 | 6/2005 | Acres |
| 6,942,566 | B2 | 9/2005 | Baerlocher et al. |
| 6,942,567 | B2 | 9/2005 | Baerlocher et al. |
| RE38,812 | E | 10/2005 | Acres et al. |
| 6,996,834 | B2 | 2/2006 | Chen |
| 7,001,273 | B2 | 2/2006 | Baerlocher |
| 7,040,984 | B2 | 5/2006 | Mead |
| 7,056,215 | B1 | 6/2006 | Olive |
| 7,160,186 | B2 | 1/2007 | Cuddy et al. |
| 7,192,349 | B2 | 3/2007 | Baerlocher et al. |
| 7,223,172 | B2 | 5/2007 | Baerlocher et al. |
| 7,273,415 | B2 | 9/2007 | Cregan et al. |
| 7,294,054 | B2 | 11/2007 | Schugar et al. |
| 7,297,059 | B2 | 11/2007 | Vancura et al. |
| 2002/0071557 | A1 | 6/2002 | Nguyen |
| 2002/0116615 | A1 | 8/2002 | Nguyen et al. |
| 2002/0138594 | A1 | 9/2002 | Rowe |
| 2002/0142846 | A1 | 10/2002 | Paulsen |
| 2002/0187834 | A1 | 12/2002 | Rowe et al. |
| 2003/0030211 | A1 | 2/2003 | Brown |
| 2003/0242297 | | 2/2003 | Rowe |
| 2003/0060266 | A1 | 3/2003 | Baerlocher |
| 2003/0060269 | A1 | 3/2003 | Paulsen et al. |
| 2003/0060279 | A1 | 3/2003 | Torango |
| 2003/0078101 | A1 | 4/2003 | Schneider et al. |
| 2003/0083943 | A1 | 5/2003 | Adams et al. |
| 2003/0216166 | A1 | 11/2003 | Baerlocher et al. |
| 2003/0222402 | A1 | 12/2003 | Olive |
| 2004/0009811 | A1 | 1/2004 | Torango |
| 2004/0048644 | A1 | 3/2004 | Gerrard et al. |
| 2004/0142742 | A1 | 7/2004 | Schneider et al. |
| 2005/0119047 | A1 | 6/2005 | Olive |
| 2005/0143168 | A1 | 6/2005 | Torango |
| 2005/0176488 | A1 | 8/2005 | Olive |
| 2005/0181860 | A1 | 8/2005 | Nguyen et al. |
| 2005/0209004 | A1 | 9/2005 | Torango |
| 2006/0030403 | A1 | 2/2006 | Lafky et al. |
| 2006/0035694 | A1 | 2/2006 | Fuller |
| 2006/0040723 | A1 | 2/2006 | Baerlocher et al. |
| 2006/0040732 | A1 | 2/2006 | Baerlocher et al. |
| 2006/0040733 | A1 | 2/2006 | Baerlocher et al. |
| 2006/0040734 | A1 | 2/2006 | Baerlocher et al. |
| 2006/0040736 | A1 | 2/2006 | Baerlocher et al. |
| 2006/0073887 | A1 | 4/2006 | Nguyen et al. |
| 2006/0142079 | A1 | 6/2006 | Ikehara et al. |
| 2006/0160620 | A1 | 7/2006 | Matthews et al. |
| 2006/0183535 | A1 | 8/2006 | Marks et al. |
| 2006/0183538 | A1 | 8/2006 | Michaelson et al. |
| 2006/0236116 | A1 | 10/2006 | Patel |
| 2006/0287077 | A1 | 12/2006 | Grav et al. |
| 2007/0054732 | A1 | 3/2007 | Baerlocher |
| 2007/0054733 | A1 | 3/2007 | Baerlocher |
| 2007/0060271 | A1 | 3/2007 | Cregan et al. |
| 2007/0060297 | A1 | 3/2007 | Hein et al. |
| 2007/0060314 | A1 | 3/2007 | Baerlocher et al. |
| 2007/0060320 | A1 | 3/2007 | Kelly et al. |
| 2007/0060321 | A1 | 3/2007 | Vasquez et al. |
| 2007/0060375 | A1 | 3/2007 | Hein et al. |
| 2007/0077979 | A1 | 4/2007 | Cohn et al. |
| 2007/0077990 | A1 | 4/2007 | Cuddy et al. |

| | | | |
|---|---|---|---|
| 2007/0105620 | A1 | 5/2007 | Cuddy et al. |
| 2007/0155485 | A1 | 7/2007 | Cuddy et al. |
| 2007/0167212 | A1 | 7/2007 | Nguyen |
| 2007/0184887 | A1 | 8/2007 | Cannon |
| 2007/0191088 | A1 | 8/2007 | Breckner et al. |
| 2007/0213114 | A1 | 9/2007 | Caspers et al. |
| 2007/0218975 | A1 | 9/2007 | Iddings et al. |
| 2007/0218982 | A1 | 9/2007 | Baerlocher |
| 2007/0243925 | A1 | 10/2007 | LeMay et al. |
| 2007/0243934 | A1 | 10/2007 | Little et al. |
| 2007/0259709 | A1 | 11/2007 | Kelly et al. |
| 2008/0102934 | A1 | 5/2008 | Tan |
| 2008/0311979 | A1 | 12/2008 | Walker et al. |

FOREIGN PATENT DOCUMENTS

| | | |
|---|---|---|
| WO | WO 00 12186 | 3/2000 |
| WO | WO 00 32286 | 6/2000 |
| WO | WO 2005 083599 | 9/2005 |
| WO | WO 2005 099425 | 10/2005 |
| WO | WO 2007 040674 | 4/2007 |
| WO | WO 2007 078533 | 7/2007 |

OTHER PUBLICATIONS

Integrated Real Time On-Line Slot System—SDI, written by GRIPS Electronic GmbH, printed from website reported as archived on Feb. 20, 1997 (available at http://web.archive.org/web/19970220165559/www.grips.com/sdi.htm).

PEM—Precision Electronic Meter, written by GRIPS Electronic GmbH, printed from website reported as archived on Feb. 20, 1997 (available at http://web.archive.org/web/19970220165753/www.grips.com/pem.htm).

Progressive Jackpot System article, printed from casinomagazine.com.managearticle.asp©c_290&a=518, on Jun. 21, 2004.

ProLINK Progressive Controller User/Reference Manual, written by Casino Data Systems, published in Apr. 1997.

Slot Machines A Pictorial History of the First 100 Years (pp. 216, 242 to 243), 5th edition, written by Marshall Fey, published in 1983-1997.

Wide Area Progressive Link System, written by GRIPS Electronic GmbH, printed from website reported as archived on Feb. 20, 1997 (available at http://web.archive.org/web/19970220165457/www.grips.com/wap.htm).

GAMING SYSTEM AND METHOD FOR PROVIDING MULTI-LEVEL PERSONAL PROGRESSIVE AWARDS

PRIORITY CLAIM

This application is a continuation of, claims priority to and the benefit of U.S. patent application Ser. No. 11/927,029, filed on Oct. 29, 2007 (now U.S. Pat. No. 8,197,337), the entire contents of which is incorporated by reference herein.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and on the amount of the wager (e.g., the higher the wager, the higher the award). Symbols or symbol combinations which are less likely to occur usually provide higher awards.

In such known gaming machines, the amount of the wager made on the base game by the player may vary. For instance, the gaming machine may enable the player to wager a minimum number of credits, such as one credit (e.g., one cent, nickel, dime, quarter or dollar) up to a maximum number of credits, such as five credits. This wager may be made by the player a single time or multiple times in a single play of the primary game. For instance, a slot game may have one or more paylines and the slot game may enable the player to make a wager on each payline in a single play of the primary game. Thus, it is known that a gaming machine, such as a slot game, may enable players to make wagers of substantially different amounts on each play of the primary or base game ranging, for example, from one credit up to 125 credits (e.g., five credits on each of 25 separate paylines). This is also true for other wagering games, such as video draw poker, where players can wager one or more credits on each hand and where multiple hands can be played simultaneously. Accordingly, it should be appreciated that different players play at substantially different wagering amounts or levels and at substantially different rates of play.

Secondary or bonus games are also known in gaming machines. The secondary or bonus games usually provide an additional award to the player. Secondary or bonus games usually do not require an additional wager by the player to be activated. Secondary or bonus games are generally activated or triggered upon an occurrence of a designated triggering symbol or triggering symbol combination in the primary or base game. For instance, a bonus symbol occurring on the payline on the third reel of a three reel slot machine may trigger the secondary bonus game. When a secondary or bonus game is triggered, the gaming machines generally indicates this to the player through one or more visual and/or audio output devices, such as the reels, lights, speakers, video screens, etc. Part of the enjoyment and excitement of playing certain gaming machines is the occurrence or triggering of the secondary or bonus game (even before the player knows how much the bonus award will be).

Progressive awards associated with gaming machines are also known. In one form, a progressive award is an award amount which includes an initial amount and an additional amount funded through a portion of each wager made on the progressive gaming machine. For example, 0.1% of each wager placed on the primary game of a gaming machine may be allocated to the progressive award or progressive award fund. The progressive award grows in value as more players play the gaming machine and more portions of the players' wagers are allocated to the progressive award. When a player obtains a winning symbol or symbol combination which results in the progressive award, the accumulated progressive award is provided to the player. After the progressive award is provided to the player, the amount of the next progressive award is reset to the initial value and a portion of each subsequent wager is allocated to the next progressive award.

A progressive award may be associated with a single gaming machine or multiple gaming machines which each contribute portions of the progressive award. The multiple gaming machines may be in the same bank of machines, in the same casino or gaming establishment (usually through a local area network ("LAN")) or in two or more different casinos or gaming establishments (usually through a wide area network ("WAN")). Such progressive awards are sometimes called local area progressives ("LAP") and wide area progressives ("WAP"), respectively.

Moreover, a gaming machine or bank of gaming machines may be simultaneously associated with a plurality of progressive awards. In these multi-level progressive ("MLP") configurations, a plurality of progressive awards start at different award or value levels, such as $10, $100, $1000 and $10,000 and each individually increment or increase until provided to a player. Upon a suitable triggering event at one of more of the gaming devices associated with the MLP, one or more of the progressive awards which form the MLP are provided to one or more of the players at such gaming devices.

While such progressive awards are popular amongst players, a number of problems exist, such as only one person typically wins the progressive award. This may discourage the other players who have also been playing for a long period of time. Such discouragement can lead to players walking away with jackpot fatigue. Jackpot fatigue can occur when a player no longer finds an award desirable or worth the cost of continuing to play. This desire to quit playing is also due to the fact that a player may feel they must wait a substantial period of time for the jackpot to climb back to a high value. That is, when a progressive award is provided at a different gaming machine, a player may feel deflated and not wish to continue playing for a base or reset level progressive award.

A personal progressive award formed by allocating a percentage of a player's wager to a progressive award (or into a pool) specific to that player is also known. Upon the occurrence of an event, the amount allocated to the player's own personal progressive award is returned to the player. Such personal progressive awards typically take a very long time to increase to a desirable amount because only the player who can win it is contributing to it. This serves to devolitize the game played because each game is simply returning a percentage of a player's wager back to the player at some interval (in the form of the progressive award).

There is a continuing need to provide new and different gaming machines and gaming systems which offer the player the opportunity to make one or more game play decisions regarding whether to play for a personal progressive award or a non-personal progressive award and further regarding how likely they are to win such progressive awards.

SUMMARY

In one embodiment, the gaming system and method disclosed herein includes at least one designated or gaming system progressive award providable to any player at one of a plurality of the gaming machines and gaming devices in the gaming system. In one such embodiment, the designated or gaming system progressive award is associated with a designated quantity of points wherein the first player at one of the gaming devices who accumulates the designated quantity of points is provided the designated or gaming system progressive award. The gaming system and method disclosed herein also includes, for each of a plurality of players at the gaming devices in the gaming system, a plurality of personal progressive awards arranged in a personal multi-level progressive (MLP) configuration. Such personal progressive awards are individual to each specific player and funded by that player's wagers placed at the gaming devices in the gaming system. Accordingly, the gaming system and method disclosed herein includes at least one designated or gaming system progressive award (i.e., a non-personal progressive award) which is available to be provided to any qualified player at any of the gaming devices in the gaming system and further includes a plurality of personal progressive awards which are each respectively available to be provided to the specific individual players of the gaming devices in the gaming system.

In operation of one embodiment of the gaming system disclosed herein, upon an occurrence of a suitable triggering event, a player at one of the gaming devices is provided an opportunity to play for the personal progressive awards of the personal MLP associated with that player. As a result of the opportunity to play for the personal progressive award, the player is provided a quantity of points. Such provided points accumulate for the player over one or more opportunities to play for one or more of the personal progressive awards associated with that player, wherein if the player has accumulated the designated number of points associated with the designated or gaming system progressive award, the player is provided the designated or gaming system progressive award.

In this embodiment, in addition to accumulating points while playing for one of the personal progressive awards, the opportunity to play for a personal progressive award also includes a determination of whether the player is successful in the opportunity to play for one of the personal progressive awards. If the determination is that the player is successful, the gaming device enables the player to either accept the played for personal progressive award or forfeit the played for personal progressive award. If the player accepts the played for personal progressive award, that personal progressive award is provided to the player and any accumulated points are forfeited. That is, in exchange for accepting the personal progressive award, the player's accumulated points toward winning the designated or gaming system progressive award are reset. On the other hand, if the player forfeits the played for personal progressive award, the value of the forfeited personal progressive award is added to the designated or gaming system progressive award and the player retains their accumulated points in hopes of accumulating additional points during a subsequent opportunity to play for another one of the personal progressive awards of the personal MLP. That is, in exchange for rejecting the personal progressive award, the value of the rejected personal progressive award funds the designated or gaming system progressive award and the player's accumulated points toward winning the designated or gaming system progressive award are maintained.

In one embodiment, the gaming system disclosed herein includes a central server, central controller or remote host in communication with or linked to a plurality of gaming machines or gaming devices. In one such embodiment, the central server keeps track of the amounts wagered and the play on each gaming device in the gaming system and/or the amounts wagered and the play of each player at each gaming device in the gaming system. In one embodiment, the central server maintains, for each of a plurality of players at the gaming devices in the gaming system, a plurality of personal progressive awards arranged in a personal MLP configuration. In one embodiment, such personal progressive awards are funded by allocating a percentage of a player's coin-in or wagered amounts to one or more of the personal progressive awards of the personal MLP associated with that player. In addition to maintaining a plurality of personal progressive awards for a plurality of players, the central server also maintains at least one designated or gaming system progressive award for the gaming devices in the gaming system. As described below, in various embodiments, such a designated or gaming system progressive award is funded, at least in part, based on the maintained personal progressive awards which are forfeited by players and otherwise not provided to such players.

In one embodiment, upon a suitable triggering event occurring at or in association with one of the gaming devices in the gaming system, the player at that gaming device is provided an opportunity to play for one of the personal progressive awards maintained for that player. In one such embodiment, the triggering event occurs for a specific player based on that player's wagering or coin-in activity. In this embodiment, upon the specific player wagering a designated amount of coin-in at one or more of the gaming devices in the gaming system, the central server causes the triggering event to occur in association with the player's currently played gaming device. For example, for every $15 wagered by a player, the central server causes a triggering event to occur and provides the player an opportunity to play for one of the personal progressive awards maintained for that player. Such a configuration of funding a player's personal progressive award based on that player's wagering history or coin-in and also causing the triggering event to occur based on each player's respective wagering history or coin-in provides that each player's personal progressive awards are adequately funded when the triggering event occurs.

In one embodiment, the opportunity to play for one of the maintained personal progressive awards is provided as a multi-round progressive award game. In one such multi-round progressive award game, the gaming device enables the player to make one or more decisions or inputs, wherein such decisions or inputs determine a quantity of points provided to the player. That is, based on how well (and/or how lucky) the player is with their decisions or inputs in the multi-round progressive award game determines the quantity of points provided to the player. For example, a first round of the multi-round progressive award game includes a plurality of selections wherein if the player picks a designated one of the selections, the gaming device provides the player ten points. In this example, if the player picks a selection other than the designated selection, the gaming device either provides the player zero points or alternatively subtracts five points from the player's accumulated points.

In one embodiment, any provided points accumulate for the player wherein if the player has accumulated the designated number of points associated with the designated or gaming system progressive award, the player is provided the designated or gaming system progressive award. In this embodiment, the gaming system provides the gaming system progressive award to the first player to accumulate the designated number of points associated with the gaming system progressive award. For example, the first player to accumulate five-hundred points is provided the gaming system progressive award. It should be appreciated that as a plurality of players at the gaming devices in the gaming system are accumulating points to reach the designated number of points associated with the gaming system progressive award, the gaming system disclosed herein provides an element of competition as players race against each other to trigger multi-round progressive award games to accumulate more points to try and win the gaming system progressive award.

In one embodiment, in addition to determining a quantity of points to provide to the player, the player's decisions or inputs in the multi-round progressive award game determine if the player is offered the played for personal progressive award. That is, the multi-round progressive award game includes at least a first determination of a quantity of points toward a gaming system progressive award to provide to a player and a second, independent determination of if the player is offered the played for personal progressive award. In one embodiment, if the player's decisions or inputs in the multi-round progressive award game do not result in the gaming device offering the player the currently played for personal progressive award (i.e., the player is unsuccessful in the opportunity to play for one of the personal progressive awards of the personal MLP associated with that player), the progressive award game terminates and the player returns to base game play. In this embodiment, the player retains any accumulated points and upon the next occurrence of the triggering event (i.e., upon the player wagering the designated amount of coin-in), the gaming device enables the player to participate in the same progressive award game which the player was previously unsuccessful. In one such embodiment, upon the next occurrence of the triggering event, the gaming system resumes the progressive award game at substantially the same point which the player left off. Utilizing the example described above, if the player picks a selection other than the designated selection (i.e., the player is unsuccessful in the multi-round progressive award game), the next multi-round progressive award game includes the same plurality of selections (including the same designated selection) for the player to pick. In this example, the player may remember the incorrect selection they previously picked and avoid picking that selection again in subsequent progressive award games. Such a configuration provides that players build an advantage each time they access and move further along in the progressive award game.

In one embodiment, if the player's decisions or inputs in the progressive award game result in the gaming device offering the player the currently played for personal progressive award (i.e., the player is successful in the opportunity to play for one of the personal progressive awards of the personal MLP associated with that player), the gaming device enables the player to either accept or reject the played for personal progressive award. If the player accepts the personal progressive award, the personal progressive award is provided to the player and any accumulated points are forfeited. On the other hand, if the player rejects or forfeits the played for personal progressive award, the player retains their accumulated number of points and will participate in a different progressive award game for a different personal progressive award upon the next occurrence of the triggering event (i.e., upon the player wagering the designated amount of coin-in).

It should be appreciated that the player's decision to accept the personal progressive award and forfeit any accumulated points or reject the personal progressive award and continue accumulating points in subsequent progressive award games is based on a plurality of factors, such as, but not limited to, the value of the personal progressive award, the value of the gaming system progressive award, the player's current quantity of accumulated points, the designated quantity of accumulated points associated with winning the gaming system progressive award, and the quantity of points accumulated by one or more other players at gaming devices in the gaming system. For example, if a player is successful in a multi-round progressive award game played for a personal progressive award of $35, the player has accumulated fifty points, the quantity of points associated with a gaming system progressive award of $500 is one-thousand and another player at another gaming device has accumulated nine-hundred points, the player may decide to accept the personal progressive award of $35 and forfeit the fifty accumulated points. In another example, if a player is successful in a multi-round progressive award game played for a personal progressive award of $15, the player has accumulated eight-hundred-fifty points, the quantity of points associated with the gaming system progressive award of $500 is one-thousand and another player at another gaming device with the next highest quantity of accumulated points is eight-hundred points, the player may decide to reject the personal progressive award of $15, retain their eight-hundred-fifty accumulated points and try to win the gaming system progressive award by accumulating one-hundred-fifty additional points during one or more subsequent progressive award games.

In one embodiment, if the player forfeits the played for personal progressive award, the value of the forfeited personal progressive award is added to the designated or gaming system progressive award. For example, if a player rejects a personal progressive award of $15, this personal progressive award reset to an appropriate reset value and $15 is added to a designated or gaming system progressive award of $500 to result in an updated designated or gaming system progressive award of $515. Such a configuration provides that one or more progressive awards which are personal to and can only be provided to a specific player are converted to designated or gaming system progressive awards which are available to be provided to any player that otherwise qualifies.

Accordingly, an advantage of the gaming system and method disclosed herein is to provide a gaming system and method which enables a player to play for one or more personal progressive awards while accumulating a number of points. The number of points is used to further enable the player to compete with other players to try and win a designated or gaming system progressive award. Such a configuration creates an element of competition by enabling players to compare progress toward winning a designated progressive award to each other. Such a configuration further creates an element of strategy as each player must decide whether to accept a personal progressive award and forfeit any accumulated points or reject the personal progressive award and try to continue accumulating points in subsequent progressive award games.

Another advantage of the gaming system and method disclosed herein is that unlike known gaming devices that determine which progressive award of an MLP configuration to provide to a player based on game outcome events, the gaming system and method disclosed herein determines which personal progressive award of a personal MLP configuration to provide based on a player's decisions and actions in a multi-round progressive award game. That is, the continued play of the same or similar stages and rounds of the multi-round progressive award game enables a player to feel as though they have a sense of control in which, if any, progressive awards they win. This element of player interaction and/or skill enables players to feel as though they have a direct effect over any outcomes generated and awards provided.

Additional features and advantages are described in, and will be apparent from, the following Detailed Description and the figures.

DETAILED DESCRIPTION

The present disclosure may be implemented in various configurations for gaming machines, gaming devices or gaming systems, including but not limited to: (1) a dedicated gaming machine, gaming device or gaming system wherein the computerized instructions for controlling any games (which are provided by the gaming machine or gaming device) are provided with the gaming machine or gaming device prior to delivery to a gaming establishment; and (2) a changeable gaming machine, gaming device or gaming system where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by at least one central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
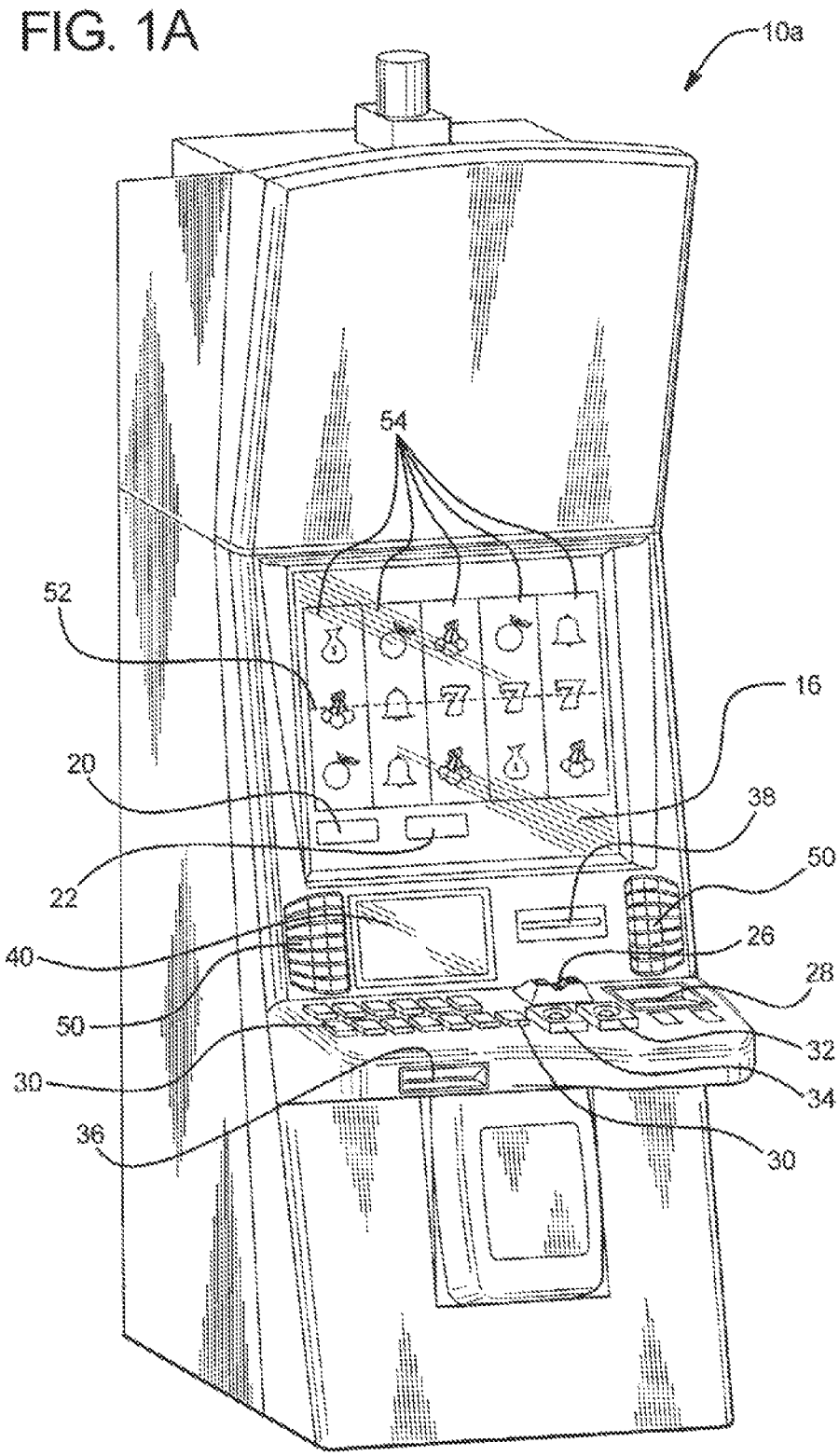
FIG. 1A is a front-side perspective view of one embodiment of the gaming device disclosed herein.
Figure 1B:
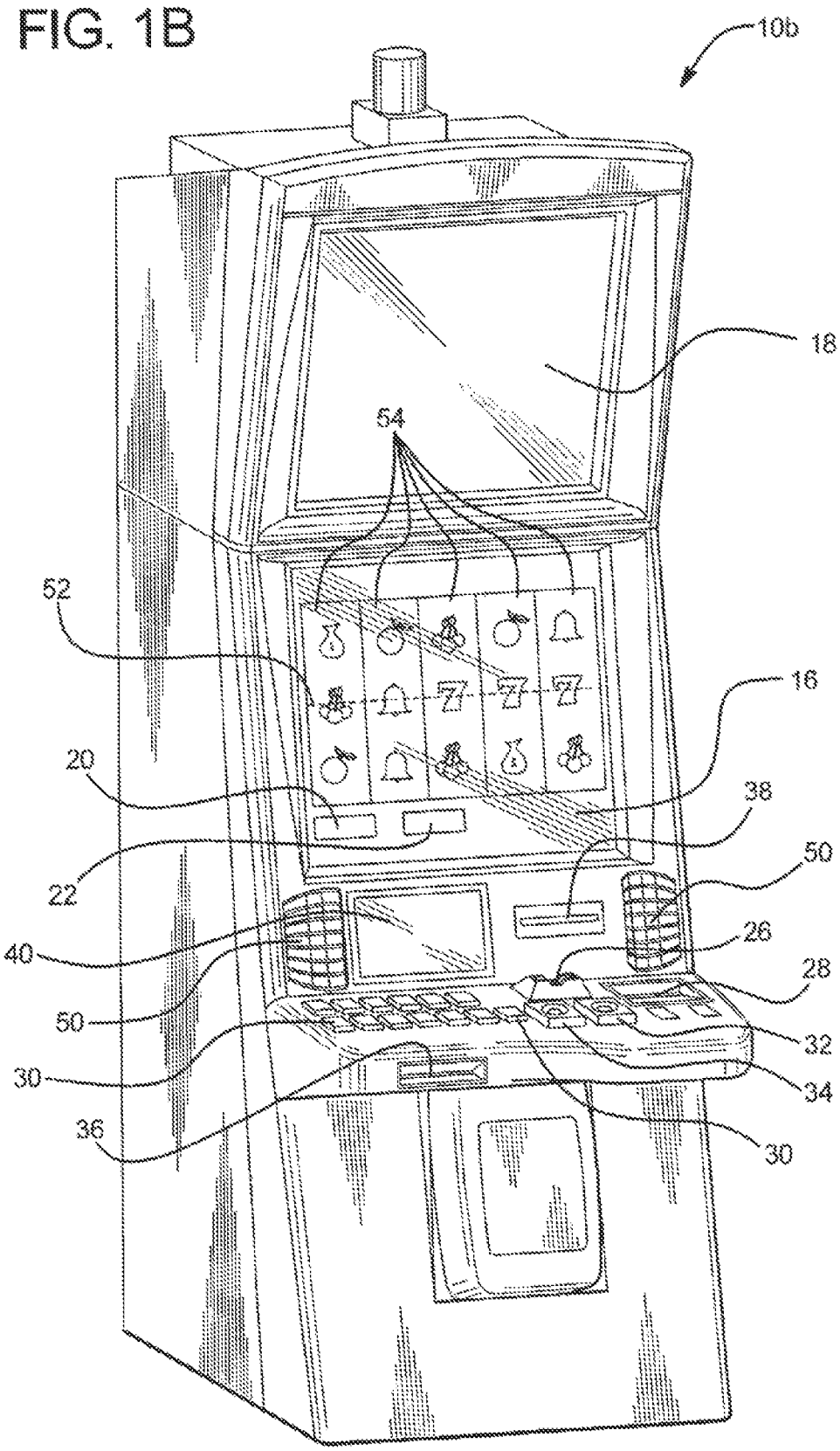
FIG. 1B is a front-side perspective view of another embodiment of the gaming device disclosed herein.

Referring now to the drawings, two example alternative embodiments of the gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
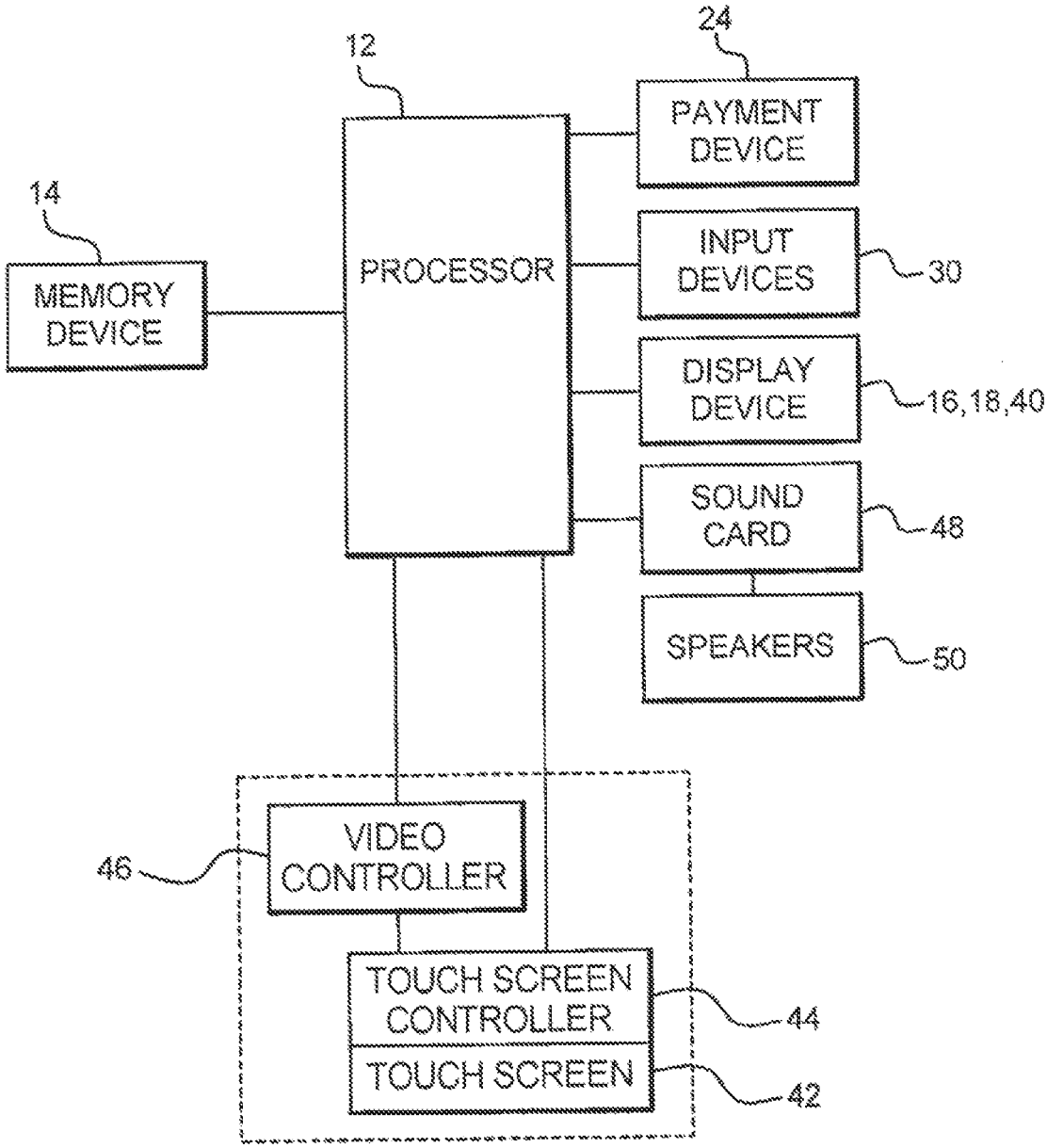
FIG. 2A is a schematic block diagram of the electronic configuration of one embodiment of the gaming device disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance or the equivalent. In one embodiment, the gaming device includes a bet display 22 which displays a player's amount wagered. In one embodiment, as described in more detail below, the gaming device includes a player tracking display 40 which displays information regarding a player's playing tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card may be implemented in accordance with the gaming device disclosed herein.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places. One such input device is a conventional touch-screen button panel.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering primary or base game. The gaming machine or device may include some or all of the features of conventional gaming machines or devices. The primary or base game may comprise any suitable reel-type game, card game, cascading or falling symbol game, number game or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, display the plurality of simulated video reels 54. Each reel 54 displays a plurality of indicia or symbols, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device with wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels, modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more or each of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols.

This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one or a plurality of the selectable indicia or numbers via an input device such as the touch screen. The gaming device then displays a series of drawn numbers to determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition may be by exceeding a certain amount of game play (such as number of games, number of credits, amount of time), or reaching a specified number of points earned during game play.

In another embodiment, the gaming device processor 12 or central server 56 randomly provides the player one or more plays of one or more secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
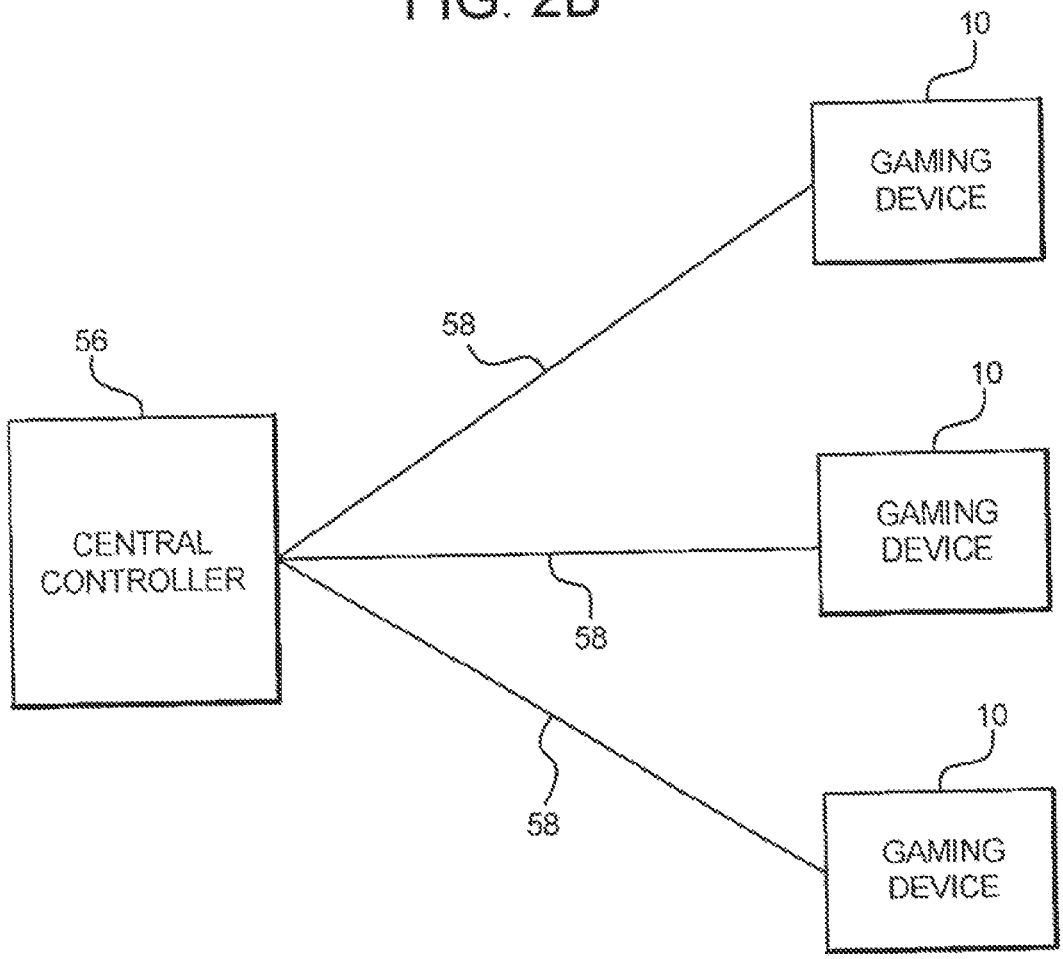
FIG. 2B is a schematic block diagram illustrating a plurality of gaming terminals in communication with a central controller.

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo, keno or lottery game. In this embodiment, each individual gaming device utilizes one or more bingo, keno or lottery games to determine the predetermined game outcome value provided to the player for the interactive game played at that gaming device. In one embodiment, the bingo, keno or lottery game is displayed to the player. In another embodiment, the bingo, keno or lottery game is not displayed to the player, but the results of the bingo, keno or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any players gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the gaming system disclosed herein is implemented via a data network, such as an internet or intranet. In one such embodiment, the operation of a gaming device can be viewed at the gaming device with at least one internet browser. In another such embodiment, the operation of a gaming device can be viewed at a location remote from the gaming device or gaming establishment utilizing at least one internet browser. In these embodiments, operation of the gaming device may be accomplished with only a connection to the central server or controller (i.e., an internet/intranet server) through a conventional phone or other data transmission line, digital subscriber line (DSL), T-1 line, coaxial cable, fiber optic cable, or other suitable connection. Accordingly, players may access an internet game page from any location where an internet connection and computer, or other internet facilitator is available. It should be appreciated that the expansion in the number of computers and number and speed of internet connections in recent years increases opportunities for players to play from an ever-increasing number of remote sites. It should be further appreciated that enhanced bandwidth of digital wireless communications may render such technology suitable for some or all communications, particularly if such communications are encrypted.

Higher data transmission speeds may be useful for enhancing the sophistication and response of the display and interaction with the player.

In one embodiment, the central server (i.e., an internet/intranet server) maintains at least one dedicated gaming site which is associated with one or more progressive awards and one or more supplemental funds as disclosed herein. In operation, a player logs onto the dedicated gaming site and the central server enables the player to wager on and participate in one or more online games at this gaming site. In this embodiment, upon the occurrence of any progressive award increase event, the central server adds a value or amount (from the maintained supplemental fund) to one or more of the progressive awards associated with the dedicated gaming site.

In one embodiment, to regulate and monitor the play of games over the internet, player's identifications are verified through credit card authentication. Through this authentication, the gaming system verifies the player, the player's age, the player's location and any other suitable information associated with the player. In one such embodiment, the gaming system utilizes the verified location information to monitor and ensure that the player in a certain location follows any applicable gaming regulations associated with that location. In another such embodiment, the gaming system utilizes the verified location information to set up different progressive awards for different regions. In this embodiment, different progressive awards are allotted per region.

In another embodiment including game play over the internet, the gaming system stores information about one or more players. In this embodiment, after a player has enrolled or identified themselves with the gaming system (via the dedicated gaming site), the gaming system stores their information, such as credit card information, preferred options, player number, name, or any other information in a database. In one such embodiment, the gaming system enables the player to set and store one or more gaming options, such as jackpot betting, side wagering, and preferred games, associated with the dedicated gaming site.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Progressive Awards

Figure 3:
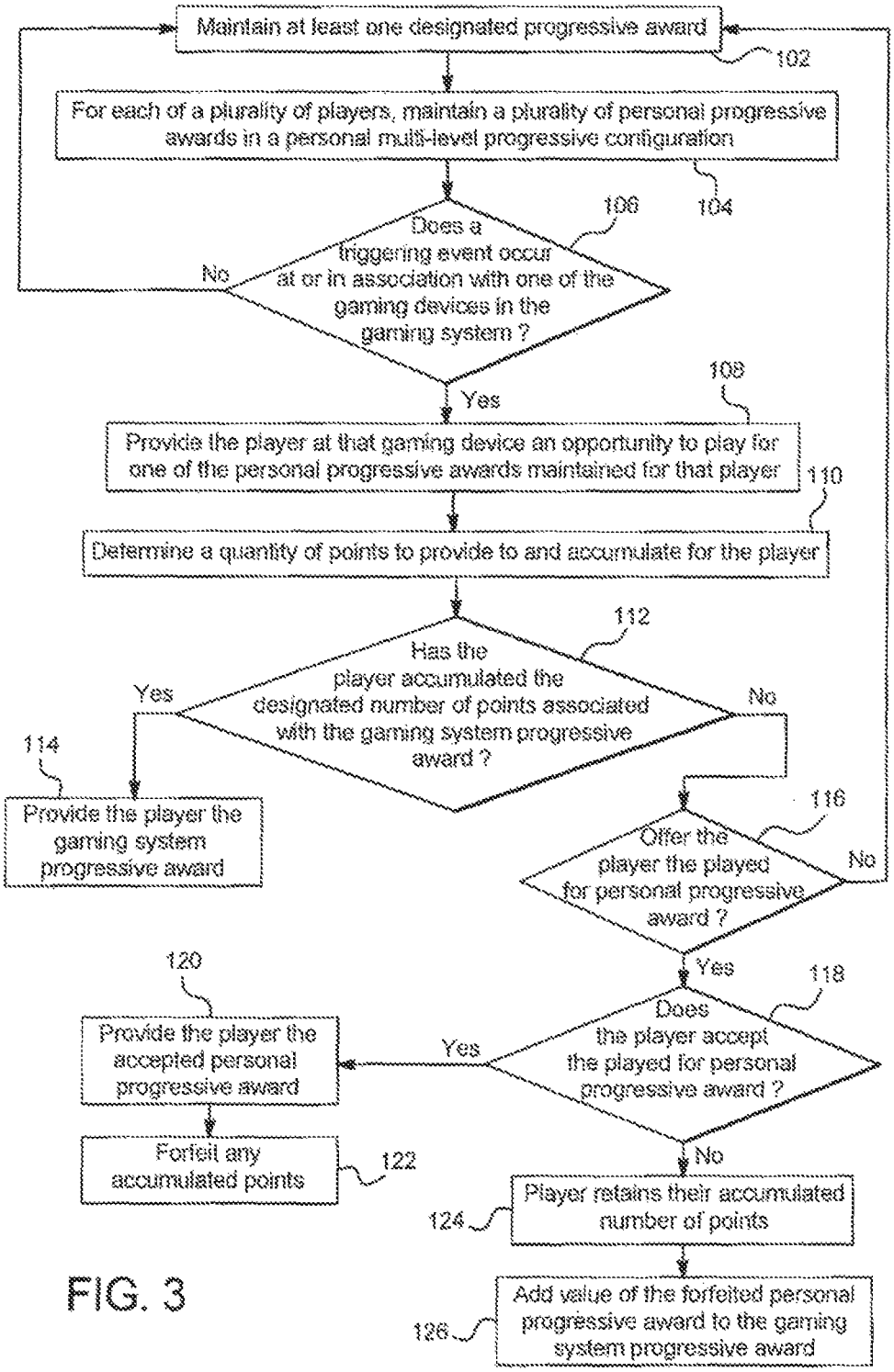
FIG. 3 is a flow-chart of one embodiment of the gaming system disclosed herein illustrating an accumulation of a quantity of points, a determination to provide a player a gaming system progressive award and a determination of whether to provide the player a personal progressive award associated with that player.
Figure 4:
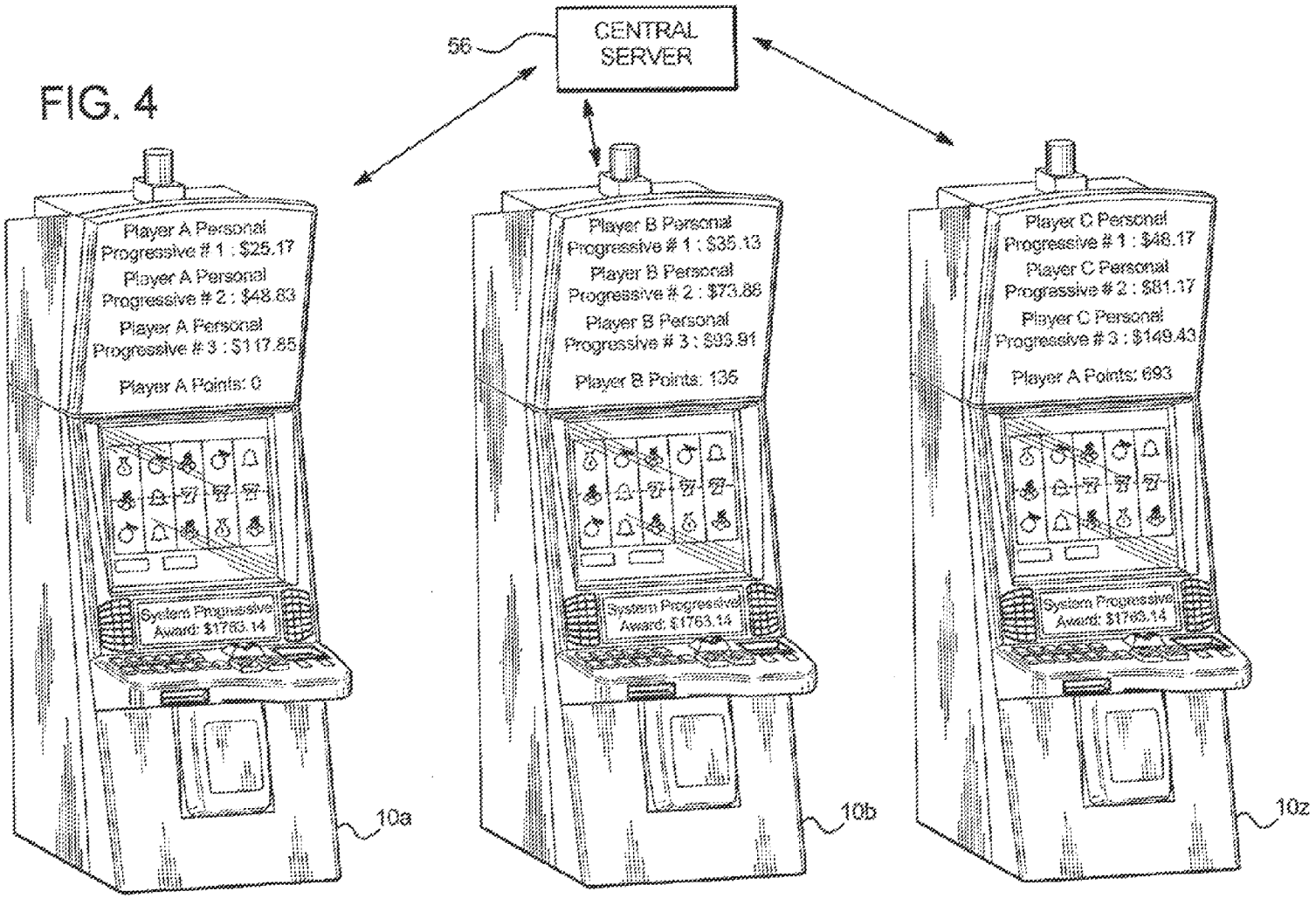
FIG. 4 is a schematic diagram of one embodiment of the gaming system disclosed herein illustrating the central server in communication with a plurality of gaming machines, wherein each gaming machine is played by a player who is associated with a plurality of personal progressive awards.

Turning now to FIGS. 3 and 4, in operation of one embodiment of the gaming system disclosed herein, the central controller and/or gaming device processor maintains at least one designated or gaming system progressive award as indicated in block 102 of FIG. 3. This gaming system progressive award is not personal to any particular player and may be won by any qualified player at any gaming device in the gaming system. In one example, as seen in FIG. 4, the gaming system maintains a gaming system progressive award currently valued at $1763.14.

In one embodiment, as described below, this designated progressive is funded, at least in part, from the personal progressive awards passed on by players who decide to play for other, greater valued progressive awards. In another embodiment, this designated progressive award is funded, at least in part, from a portion of each wager placed by a plurality of players at a plurality of the gaming devices in the gaming system. In another embodiment, the designated progressive award is funded, at least in part, from a portion of a plurality but not all of the wagers placed by a plurality of players at a plurality of the gaming devices in the gaming system. In another embodiment, the designated progressive award is funded, at least in part, from an amount provided by a gaming establishment marketing or advertisement department. It should be appreciated that any suitable manner of funding the gaming system or designated progressive award may be implemented in accordance with the gaming system disclosed herein.

In one embodiment, the designated or gaming system progressive award is associated with a designated number or quantity of points which must be accumulated by a player to win the designated progressive award. In different embodiments, the quantity of points which must be accumulated by a player to win the designated progressive award is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

Figure 5A:
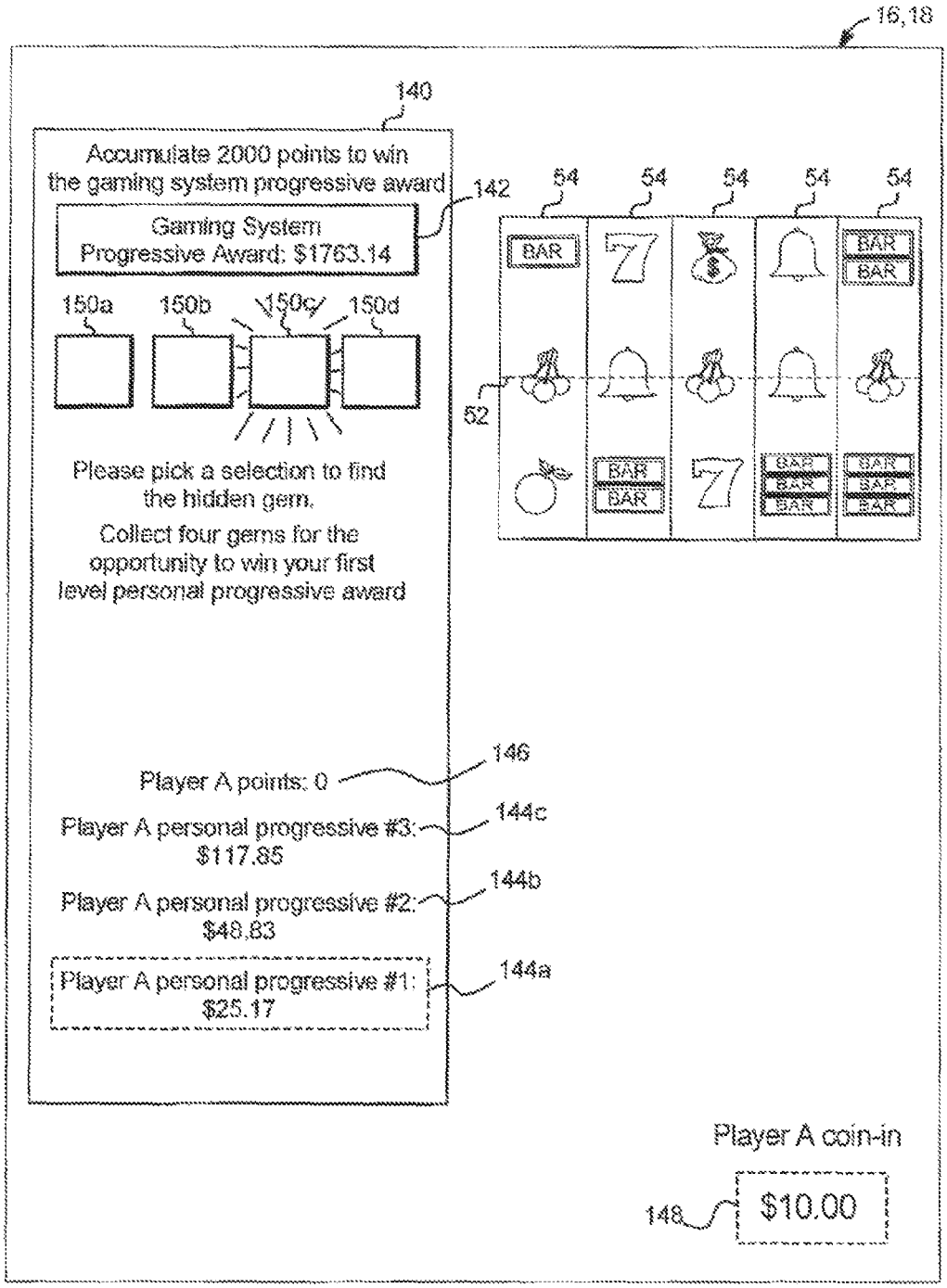
FIGS. 5A, 5B, 5C, 5D, 5E, 5F, 5G, 5H, 5I and 5J are front-side perspective views of one embodiment of a gaming system disclosed herein illustrating a plurality of rounds of a multi-round progressive award game including an accumulation of a quantity of points, a determination to provide a player a gaming system progressive award and a determination of whether to provide the player a personal progressive award associated with that player.

In one embodiment, the gaming system displays to the player the maintained gaming system progressive award and the designated number of points associated with winning that gaming system progressive award. For example, as seen in FIG. 5A, the gaming system displays to the player a maintained gaming system progressive award 142 currently valued at $1763.14 and informs the player of the designated number of points, in this example two-thousand points, which need to be accumulated for the player to win the gaming system progressive award. In one such example embodiment, the gaming device displays appropriate messages such as "ACCUMULATE 2000 POINTS TO WIN THE GAMING SYSTEM PROGRESSIVE AWARD" to the player visually, or through suitable audio or audiovisual displays.

In one embodiment, the central controller and/or gaming device processor also maintains, for each of a plurality of players at the gaming devices in the gaming system, a plurality of personal progressive awards arranged in a personal multi-level progressive (MLP) configuration as indicated in block 104 of FIG. 3. Each personal progressive award is specific to an individual player and is available to be provided to that specific player. That is, in one embodiment, no other player may win another player's personal progressive award. Thus, each player's personal progressive awards will never be reset on the player and will continue to increase, based on the contributions from that individual player's gaming activity, until offered to the player. For example, as seen in FIGS. 4 and 5A, for a first player at a first of the gaming devices (i.e., Player A), the gaming system maintains a first personal progressive award 144*a* currently valued at $25.17 (i.e., Player A Personal Progressive #1), a second personal progressive award 144*b* currently valued at $48.83 (i.e., Player A Personal Progressive #2) and a third personal progressive award 144*c* currently valued at $117.85 (i.e., Player A Personal Progressive #3). In this example, as seen in FIG. 4, for a second player at a second of the gaming devices (i.e., Player B), the gaming system maintains a first personal progressive award currently valued at $35.13 (i.e., Player B Personal Progressive #1), a second personal progressive award currently valued at $73.88 (i.e., Player B Personal Progressive #2) and a third personal progressive award currently valued at $93.91 (i.e., Player B Personal Progressive #3). Additionally, FIG. 4 illustrates that for a third player at a third of the gaming devices (i.e., Player C), the gaming system maintains a first personal progressive award currently valued at $48.17 (i.e., Player C Personal Progressive #1), a second personal progressive award currently valued at $81.17 (i.e., Player C Personal Progressive #2) and a third personal progressive award currently valued at $149.43 (i.e., Player C Personal Progressive #3).

In one embodiment, each player's personal progressive award is funded through that player's coin-in. In this embodiment, a portion of each wager placed by a player is allocated to one or more personal progressive awards associated with that player. In one embodiment, as described below, each of the player's personal progressive awards is associated with a different round or level of a multi-round progressive award game. In this embodiment, each round or level of the progressive award game is more difficult to solve, and thus more funding is generated for the higher rounds or levels of the progressive award game (as they will generally take longer to solve). For example, a first level of the personal progressive game has an average solve time associated with two hours of game play and a second level of the personal progressive game has an average solve time associated with five hours of game play. In this example, if a player is betting $1 per spin, plays 25 spins per minute and the contribution allotted for each of the player's personal progressive awards is 0.5% of that player's total coin in, the average personal progressive offered to the player for the first level of a multi-level progressive award game is $15, while the average personal progressive offered to the player for the second level of the multi-level progressive award game is $37.50.

In one embodiment, as indicated in diamond 106 of FIG. 3, the gaming system determines if a triggering event occurs at or in association with one of the gaming devices in the gaming system. In one embodiment, the gaming system tracks the occurrences of one or more suitable events occurring at or in association with one or more players and/or one or more gaming devices in the gaming system and determines, based on these tracked events, whether a triggering or designated event has occurred. In one such embodiment, the triggering or designated event occurs independent of any displayed event in any play of any game of any of the gaming devices in the gaming system. In another such embodiment, the gaming system defines one or more game play parameters, wherein each time a player's tracked game play activity satisfies the defined parameter, the triggering or designated event occurs.

In one such embodiment, the defined parameter is an amount of coin-in, wherein the triggering event occurs for a specific player based on that player's wagering or coin-in activity. In this embodiment, the gaming system determines if a specific player's amount of coin-in at one or more gaming devices in the gaming system reaches or exceeds a designated amount of coin-in (i.e., a triggering event threshold coin-in amount). That is, upon the specific player wagering a designated amount of coin-in at one or more gaming devices in the gaming system, the gaming system causes the triggering event to occur in association with the player's currently played gaming device. For example, as shown in FIG. 5A, the central server tracks an amount of coin-in for a player, in this example Player A, wherein for every $10 of coin-in wagered by Player A (as indicated in the Player A Coin-In Meter 148), the central server causes a triggering event to occur. It should be appreciated the amount of tracked coin-in associated with each player is displayed for illustration purposes only and otherwise would not likely be displayed to the player. In different embodiments, the amount of coin-in which must be wagered by a player for each occurrence of the triggering event is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In one embodiment, if the triggering event does not occur, the gaming system proceeds with maintaining the gaming system progressive award as indicated in block 102 of FIG. 3 and described above. In one such embodiment, the gaming system continues tracking the player's amount of coin-in wagered and comparing this coin-in amount to a triggering event threshold amount to determine if a triggering event occurs.

In one embodiment, if the triggering event occurs, the gaming system provides the player at that gaming device an opportunity to play for one of the personal progressive awards maintained for that player as indicated in block 108 of FIG. 3. In one embodiment, the opportunity to play for one of the personal progressive awards maintained for that player is provided by the gaming device processor. In another embodiment, the opportunity to play for one of the personal progressive awards maintained for that player is remotely provided by the central server.

In one example embodiment, as illustrated in FIG. 5A, upon the occurrence of the triggering event, the gaming system provides the player an opportunity to win one of the personal progressive awards associated with the player via a multi-level or multi-round progressive award game. In this embodiment, the gaming device forms or opens a window on the main game display, such as service window 140, to enable the player to participate in the multi-level progressive award game. It should be appreciated that any suitable manner of displaying and providing the multi-level progressive award game may be implemented in accordance with the gaming system disclosed herein.

In one embodiment, the multi-level progressive award game include a plurality of rounds or levels which the player must play through to win the different personal progressive awards maintained for the player. In this embodiment, the gaming system associates each of the personal progressive awards maintained for the player with a different level or round of the multi-level progressive award game. For example, as seen in FIG. 5A, the gaming system associates the first personal progressive award 144*a* currently valued at $25.17 (i.e., Player A Personal Progressive #1) with a first level or round of the multi-level progressive award game, associates the second personal progressive award 144*b* currently valued at $48.83 (i.e., Player A Personal Progressive #2) with a second level or round of the multi-level progressive award game, and associates the third personal progressive award 144*c* currently valued at $117.85 (i.e., Player A Personal Progressive #3) with a third level or round of the multi-level progressive award game. In this example embodiment, the player is at the first level or round of the multi-level progressive award game and is playing for the highlighted first personal progressive award associated with the first level or round.

In one embodiment, the provided opportunity to win one of the personal progressive awards associated with the player includes determining a quantity of points to provide to and accumulate for the player as indicated in block 110. In one such embodiment, the provided opportunity includes enabling the player to make one or more decisions or inputs, wherein such decisions or inputs determine, at least in part, a quantity of points provided to the player. In different embodiments, the quantity of points provided to the player for each correct input or decision is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In the example embodiment illustrated in FIG. 5A, the gaming system displays a plurality of selections 150*a*, 150*b*, 150*c* and 150*d* to the player of the multi-level progressive award game. One of the these selections is a designated selection associated with a quantity of points. In operation of the multi-level progressive award game, the gaming system enables the player to pick one of the selections in an attempt to pick the designated selection. In this example, the player picked selection 150*c*. The gaming device displays appropriate messages such as "PLEASE PICK A SELECTION TO FIND THE HIDDEN GAME" and "COLLECT FOUR GEMS FOR THE OPPORTUNITY TO WIN YOUR FIRST LEVEL PERSONAL PROGRESSIVE AWARD" to the player visually, or through suitable audio or audiovisual displays.

Figure 5B:
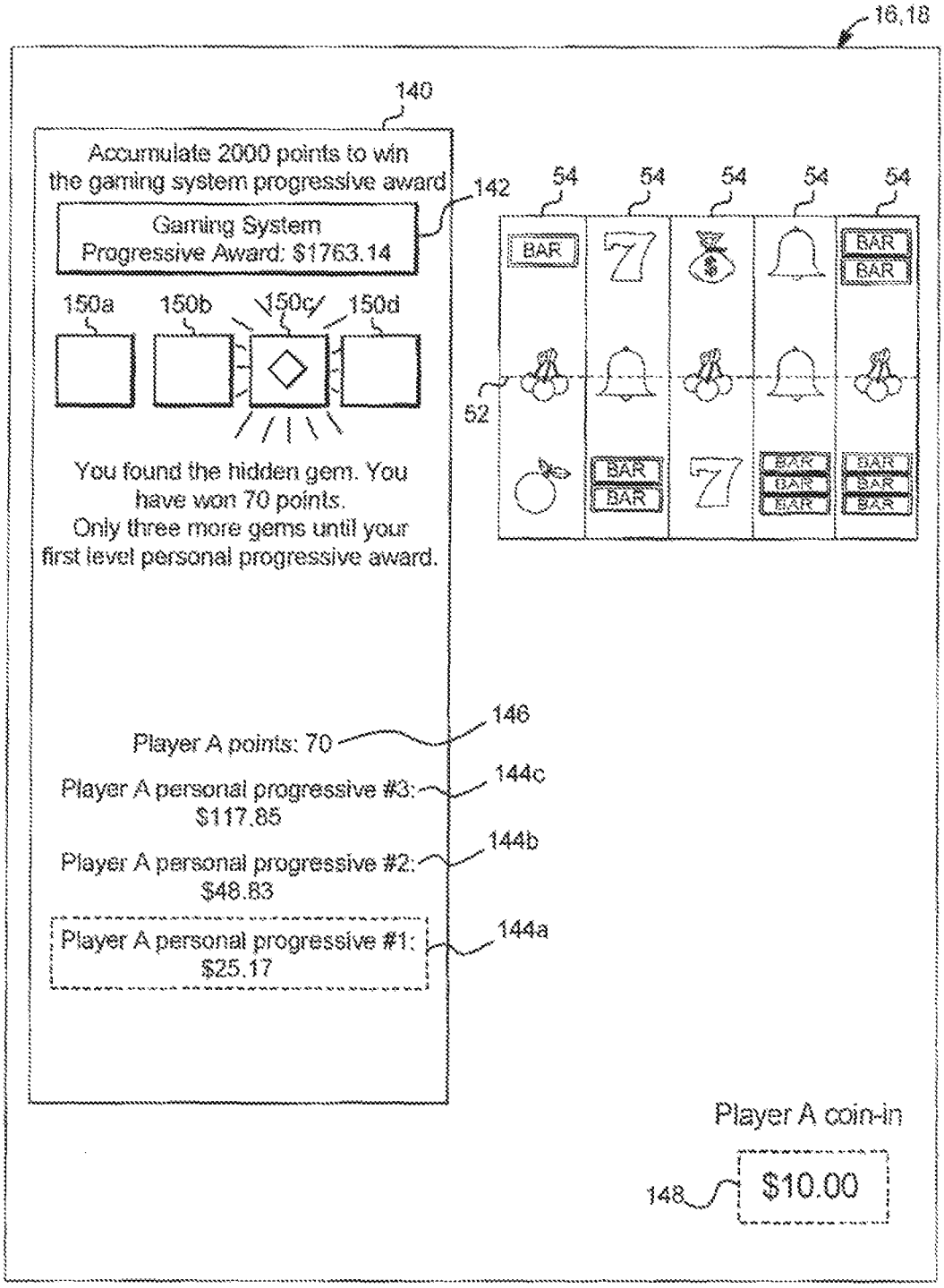

In one embodiment, the gaming system reveals if the player picked the designated selection. In the example embodiment illustrated in FIG. 5B, the player picked the designated selection and the gaming system provided the player seventy points. The quantity of points provided to the player is displayed in a Point Meter 146 (labeled "Player A Points"). The gaming device displays appropriate messages such as "YOU FOUND THE HIDDEN GEM", "YOU HAVE WON 70 POINTS" and "COLLECT THREE MORE GEMS FOR THE OPPORTUNITY TO WIN YOUR FIRST LEVEL PERSONAL PROGRESSIVE AWARD" to the player visually, or through suitable audio or audiovisual displays.

After accumulating any points for the player in the provided opportunity to win one of the personal progressive awards, the gaming system determines if the player has accumulated the designated number of points associated with the designated or gaming system progressive award as indicated on diamond 112 of FIG. 3.

If the determination is that the player has accumulated the designated number of points associated with the designated progressive award, the gaming system provides the player the designated or gaming system progressive award as indicated in block 114 of FIG. 3. In this embodiment, the gaming system provides the designated progressive award to the first player to accumulate the designated number of points associated with the designated progressive award. It should be appreciated that as a plurality of players at the gaming devices in the gaming system are accumulating points to reach the designated number of points associated with the designated progressive award, the gaming system disclosed herein provides an element of competition as players race against each other to accumulate more points to try and win the designated progressive award.

As the gaming system provides a competition as to which player can accumulate a designated quantity of points first, in one embodiment, the gaming system enables players to track their status against other players. In different embodiments, the status may be displayed through a number of mediums, such as on a gaming device, a central display device, or a casino website.

In another embodiment, if the gaming system provides the player the gaming system progressive award (i.e., the player has accumulated the designated number of points associated with the gaming system progressive award), the gaming system proceeds with the current stage of the current level of the multi-level progressive award game to determine whether to offer the player the personal progressive award associated with the current level of the multi-level progressive award game. That is, in this embodiment, the gaming system is operable to provide the player the gaming system progressive award and also provide the player one or more personal progressive awards maintained for that player from the same occurrence of a suitable triggering event.

If the determination is that the player has not accumulated the designated number of points associated with the designated progressive award, the gaming system determines whether to offer the player the played for personal progressive award as seen in diamond 116 of FIG. 3. In one such embodiment, this determination is based on the player's decisions or inputs in the provided opportunity to play for one of the personal progressive awards maintained for that player.

In one such embodiment, the determination of whether to offer the player the played for personal progressive award is based on the player completed a number of stages for the current level or round of the multi-level progressive award game. In the illustrated example, after determining that the player's seventy accumulated points does not equal or exceed the two-thousand points associated with providing the gaming system progressive award to the player, the gaming system determines if the player has successfully completed the current round or level of the multi-level progressive award game. In this example, the successful completion of the current round includes the player picking four designated selections and since the player has thus far picked one designated selection, the gaming system determines that the player has not successfully completed the current round of the multi-level progressive award game.

In one embodiment, if the determination is not to offer the player the played for personal progressive award, then regardless of the player's inputted decisions or choices, the provided opportunity to play for one of the personal progressive awards terminates and the gaming system proceeds with maintaining the gaming system progressive award as indicated in block 102 of FIG. 3 and described above. In one such embodiment, the gaming system maintains the current status of the provided multi-level progressive award game. That is, upon the next occurrence of the triggering event (i.e., upon the player wagering the designated amount of coin-in), the gaming device enables the player to participate in the same progressive award game which the player was previously unsuccessful. In other words, the player keeps playing the same multi-level progressive award game with the same available selections until they advance to the next level or round. Such a configuration provides players the advantage of learning the multi-level progressive award game as they play.

Figure 5C:
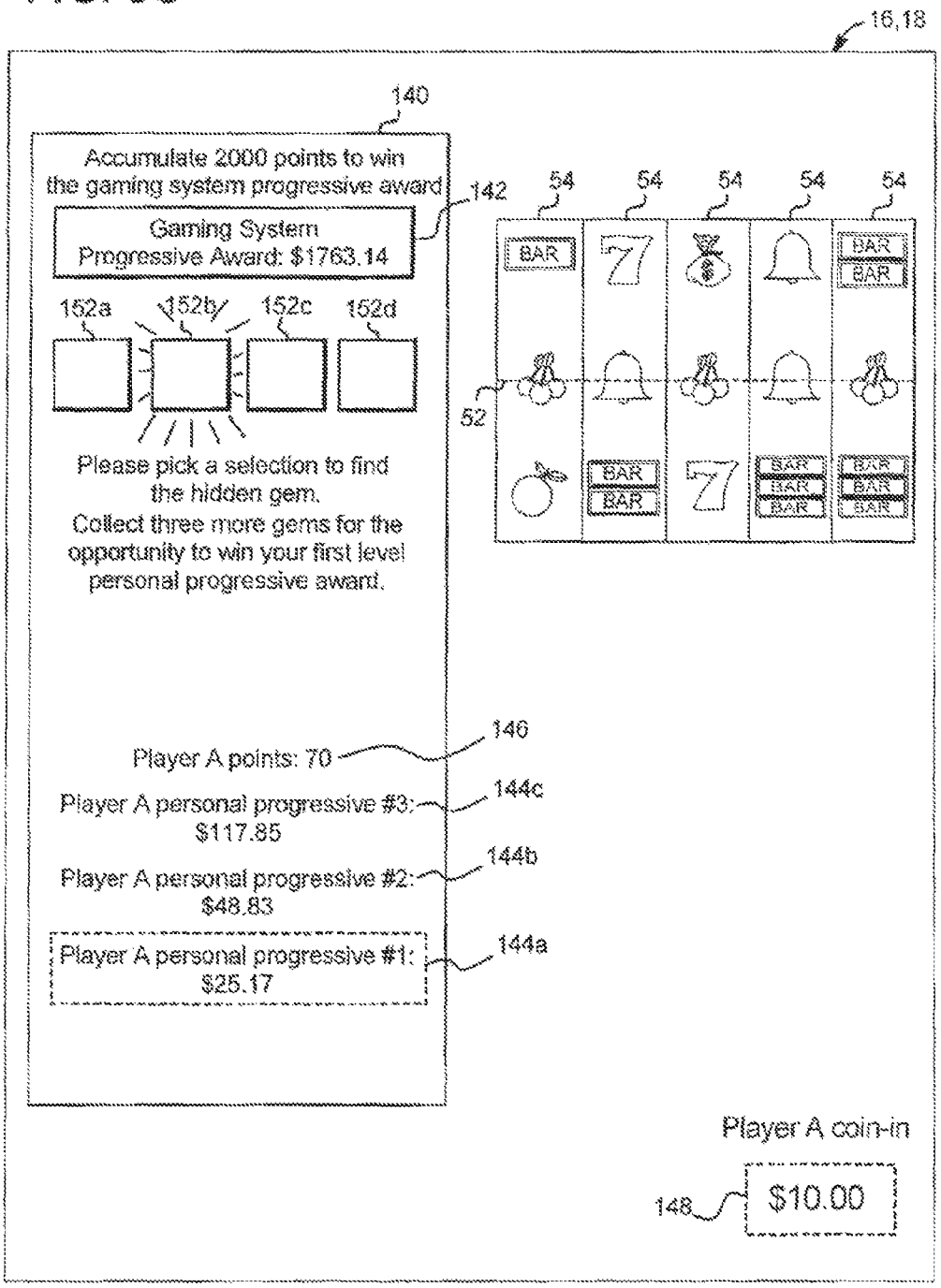

In another embodiment, if the determination is not to offer the player the played for personal progressive award and the player's inputted decisions or choices were correct, the provided opportunity to play for one of the personal progressive awards continues. In one such embodiment, if the gaming system determines that the player has not successfully completed the current round of the multi-level progressive award game, the gaming system proceeds to the next stage of the current round. For example, as illustrated in FIG. 5C, the gaming system displays another plurality of selections 152*a*, 152*b*, 152*c* and 152*d* and enables the player to pick a designated selection from this plurality of selections. In this example, the player picked selection 152*b*. The gaming device displays appropriate messages such as "PLEASE PICK A SELECTION TO FIND THE HIDDEN GAME" and "COLLECT THREE MORE GEMS FOR THE OPPORTUNITY TO WIN YOUR FIRST LEVEL PERSONAL PROGRESSIVE AWARD" to the player visually, or through suitable audio or audiovisual displays.

Figure 5D:
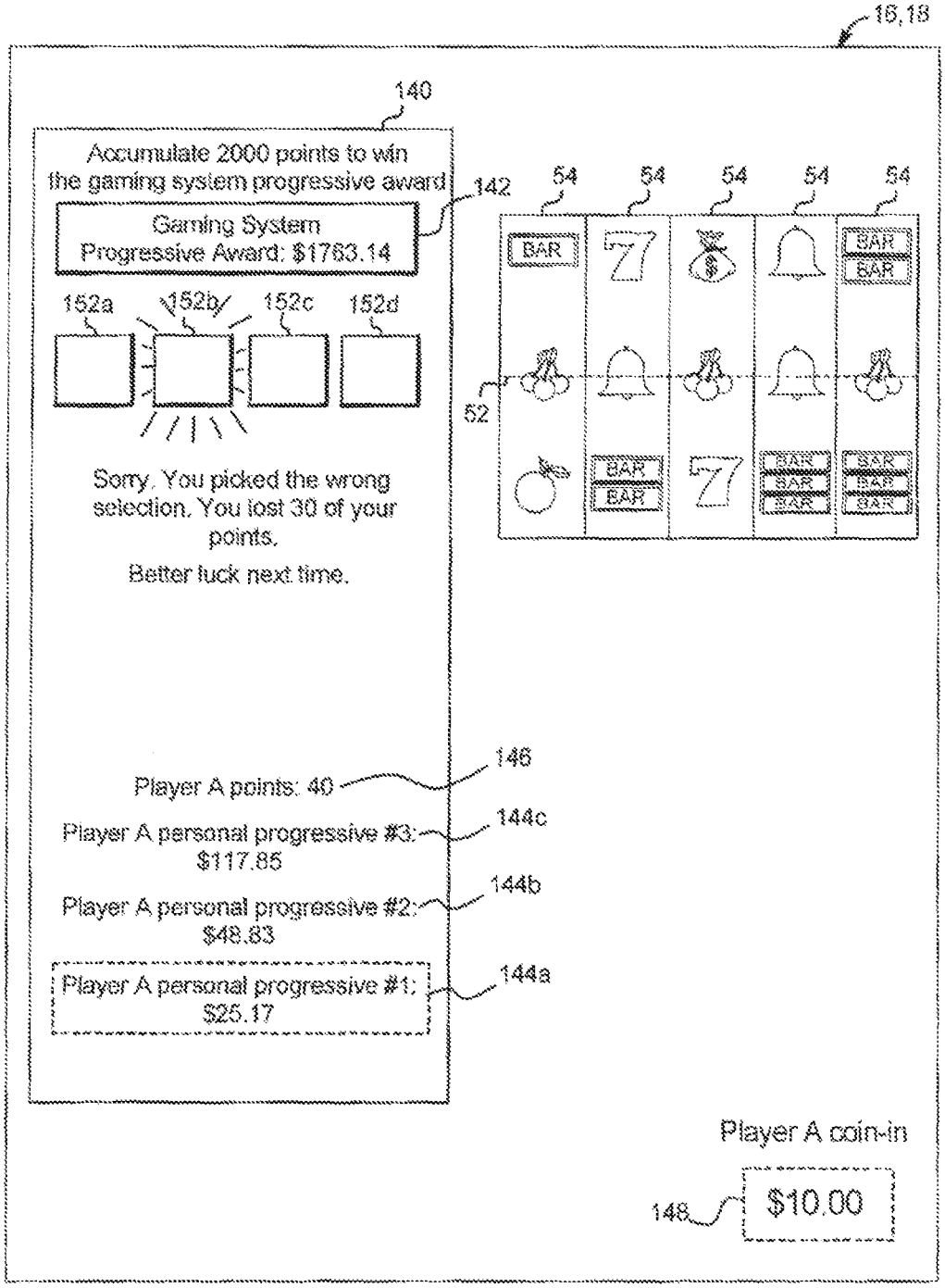

As seen in FIG. 5D, the player did not pick the designated selection, and the multi-level progressive award game terminates. The gaming device displays appropriate messages such as "SORRY, YOU PICKED THE WRONG SELECTION", "YOU LOST 30 OF YOUR POINTS" and "BETTER LUCK NEXT TIME" to the player visually, or through suitable audio or audiovisual displays.

In one embodiment, if the player does not pick the designated selection, the gaming system reveals to the player the designated selection. In this embodiment, as the next occurrence of the multi-level progressive award game includes the same plurality of selections, as long as the player remembers which selection the gaming system revealed as the designated selection, the player should correctly pick the designated selection. In another embodiment, if the player does not pick the designated selection, the gaming system keeps the designated selection concealed for a subsequent play of the multi-level progressive award game.

In one embodiment, the gaming system deducts a quantity of accumulated points from the player for not picking the designated selection. As seen in FIG. 5D, after the deduction of thirty accumulated points, the player is left with forty accumulated points 146. In another embodiment, the gaming system maintains any of the player's accumulated points (i.e., does not deduct any accumulated points) for a subsequent triggering of an opportunity to win a personal progressive award. In different embodiments, the quantity of accumulated points deducted, if any, is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In one embodiment, upon another occurrence of the triggering event, the gaming system provides the player another opportunity to win one of the personal progressive awards associated with that player, wherein this provided opportunity includes one or more features, characteristics or attributes of the previous opportunity the player participated in. In one such embodiment, the gaming system retains any of the player's accumulated points and the current state of the multi-level progressive award game for any subsequent plays of the multi-level progressive award game.

In another embodiment, upon a subsequent trigger of the multi-level progressive award game, the gaming system returns to the player to the first stage of the current level associated with the currently played for personal progressive award. It should be appreciated that in this embodiment, the correct choices of the multi-level progressive award game will not change when a player is forced to return to the beginning due to an incorrect selection. Accordingly, a player may remember the correct choices they made along the way to repeat the correct choices, thus enabling the player to play longer and move through the game more rapidly each time. That is, anytime the player is returned to the first stage, the correct answers at each stage are unaffected until the current level of the progressive award game is reset after a player is provided a personal progressive award (or passes on such a personal progressive award to advance to the next level of the progressive award game).

In another embodiment, upon a subsequent trigger of the multi-level progressive award game, the gaming system returns to the player to the previously played stage of the current level associated with the currently played for personal progressive award. For example, as illustrated in FIG. 5E, upon another occurrence of the triggering event (as evidenced by the Player A Coin-In Meter 148 reaching $20.00 and each of Player A's personal progressive awards incrementing based on a portion of the amount wagered by Player A), the gaming system resumes the multi-level progressive award game at the same stage previously played by the player.

In one alternative embodiment, to return to the previous stage of the current level of the progressive award game, the player must again play enough coin-in to enable them the right to play that stage. That is, if the player is unsuccessful in the current stage of the multi-level progressive award game, the player must wager an appropriate amount of coin-in to replay any lower stages (which the player begins at upon another occurrence of the triggering event) and each subsequent stage until they return to the previously unsuccessful stage. For example, if $10 of coin-in is required to play each stage, and the player last played stage three of the first level of the progressive award game, the player must now play another $30 (i.e., $10 for the first completed stage of the first level, $10 for the second completed stage of the first level and $10 for the second, incomplete stage of the first level) to be eligible to play stage three of the first level again. In one embodiment, in addition to wagering an appropriate amount to replay each stage, the player must again input the correct choice for each replayed stage. In another embodiment, the player must wager an appropriate amount to replay each stage, but does not need to input the correct choice for each replayed stage. It should be appreciated that such incorrect choices (and then having to repeat the stages which the player previously inputted correct choices) factor into the accumulation of points and the funding of the personal progressive awards.

Figure 5E:
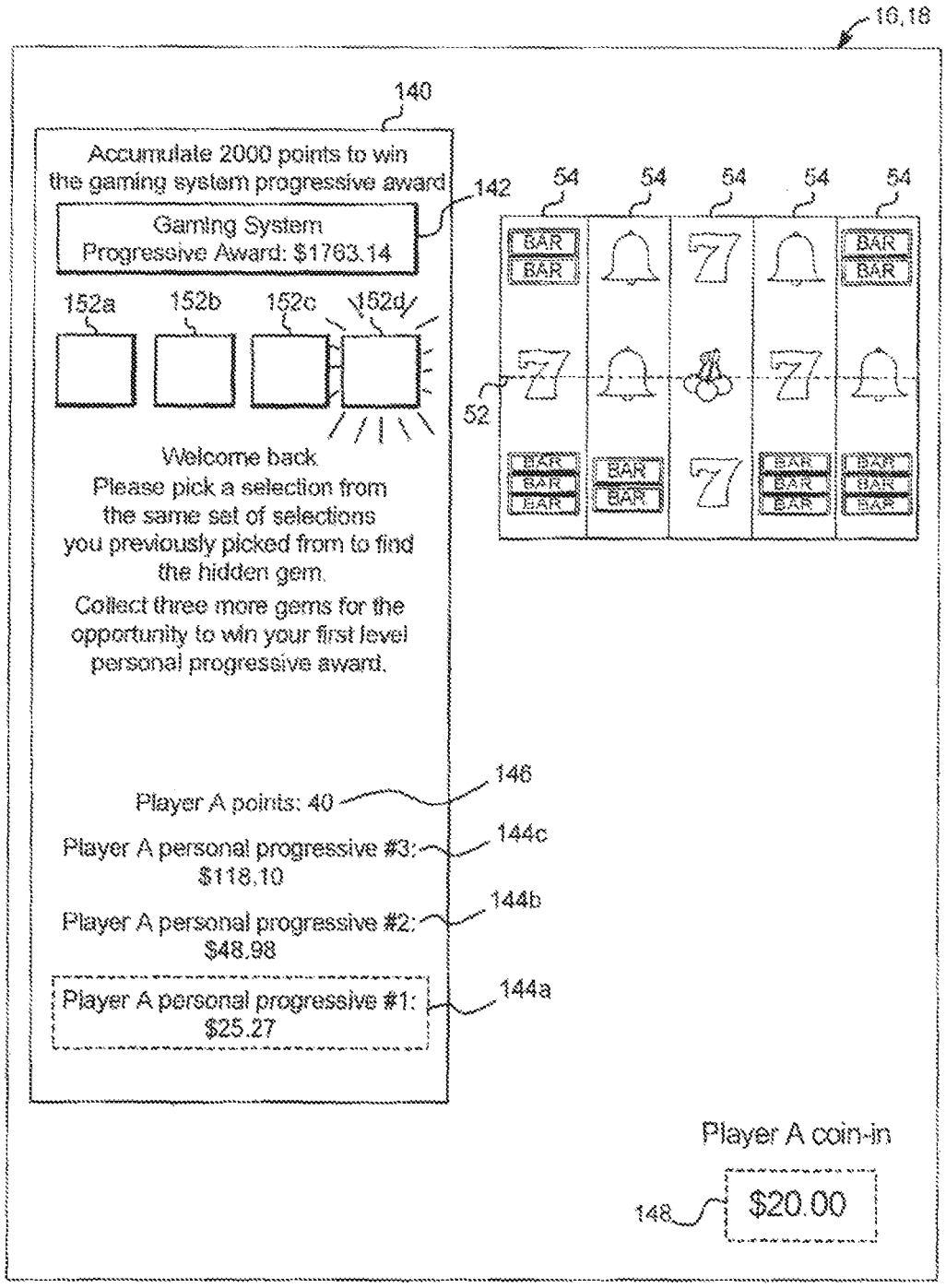

In the illustrated example, as seen in FIG. 5E, upon another triggering of the progressive award game, the gaming system displays the same plurality of selections 152*a*, 152*b*, 152*c* and 152*d* which the player previously picked a non-designated selection from. In this example embodiment, the gaming system again enables the player to pick a designated selection from this plurality of selections. In this example, with their second attempt at picking the designated selection from this plurality of selection, the player picked selection 152*d*. The gaming device displays appropriate messages such as "WELCOME BACK", PLEASE PICK A SELECTION FROM THE SAME SET OF SELECTIONS YOU PREVIOUSLY PICKED FROM TO FIND THE HIDDEN GAME" and "COLLECT THREE MORE GEMS FOR THE OPPORTUNITY TO WIN YOUR FIRST LEVEL PERSONAL PROGRESSIVE AWARD" to the player visually, or through suitable audio or audiovisual displays.

In one embodiment, the multi-level progressive award game proceeds as described above until the player successfully completes the current round or level of the multi-level progressive award game.

If the determination is to offer the player the played for personal progressive award associated with that player (i.e., the player is successful in the opportunity to play for one of the personal progressive awards of the personal MLP associated with that player), as indicated in diamond 118 of FIG. 3, the gaming device enables the player to either accept or reject the played for personal progressive award.

If the player accepts the personal progressive award, the gaming device provides the player the accepted personal progressive award and the player forfeits any accumulated points as indicated in blocks 120 and 122. That is, in exchange for accepting the personal progressive award, the player's accumulated points toward winning the designated or gaming system progressive award are reset.

On the other hand, if the player rejects or forfeits the played for personal progressive award, the player retains their accumulated number of points and the value of the forfeited personal progressive award is added to the gaming system progressive award as indicated in blocks 124 and 126 of FIG. 3. That is, in exchange for rejecting the personal progressive award, the value of the rejected personal progressive award funds the designated or gaming system progressive award and the player's accumulated points toward winning the designated or gaming system progressive award are maintained.

In one embodiment, if the player rejects the played for personal progressive award, upon the next occurrence of the triggering event (i.e., upon the player wagering the designated amount of coin-in), the player will be provided an opportunity to play for a different progressive award of the personal MLP associated with that player.

Figure 5F:
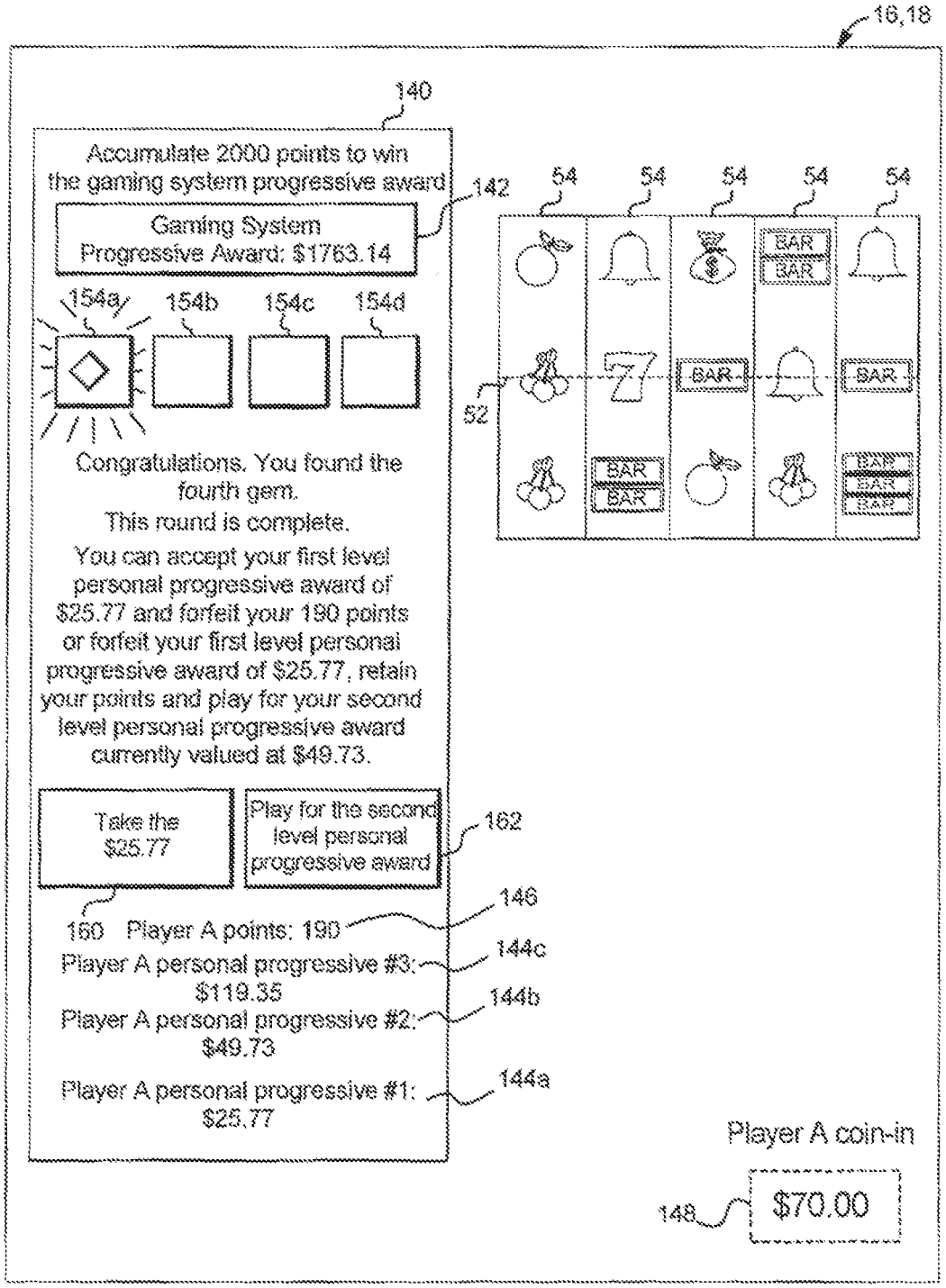

In one example embodiment, as seen in FIG. 5F, after correctly picking each of the designated selections for each of the stages of the current round or level of the multi-level progressive award game (and accumulated one-hundred-ninety points in the process) to complete the current round or level, the gaming system enables the player to accept or reject the personal progressive award associated with the completed round or level of the multi-level progressive award game. The gaming device displays appropriate messages such as "CONGRATULATIONS. YOU FOUND THE FOURTH GEM", "THIS ROUND IS COMPLETE" and "YOU CAN ACCEPT YOUR FIRST LEVEL PERSONAL PROGRESSIVE AWARD OF $25.77 AND FORFEIT YOUR 190 POINTS OR FORFEIT YOUR FIRST LEVEL PERSONAL PROGRESSIVE AWARD OF $25.77, RETAIN YOUR POINTS AND PLAY FOR YOUR SECOND LEVEL PERSONAL PROGRESSIVE WARD CURRENT VALUED AT $49.73" to the player visually, or through suitable audio or audiovisual displays.

If offered the currently played for personal progressive award, the player's decision to accept the personal progressive award and forfeit any accumulated points or reject the personal progressive award and continue accumulating points in subsequent progressive award games is based on a number of factors, such as, but not limited to, the value of the personal progressive award, the value of the gaming system progressive award, the player's current quantity of accumulated points, the designated quantity of accumulated points associated with winning the gaming system progressive award, and the quantity of points accumulated by one or more other players at gaming devices in the gaming system. For example, as seen in FIGS. 4 and 5F, after being offered the first level personal progressive award of $25.77, when determining whether to accept the offered personal progressive award or reject the offered personal progressive award, Player A may consider the value of the offered personal progressive award, the $49.73 value of the player's second level personal progressive award, the $119.35 value of the player's third level personal progressive award, the $1763.14 value of the gaming system progressive award, the player's one-hundred-ninety points, Player B's one-hundred-thirty-five points, Player C's six-hundred-ninety-three points and the two-thousand points associated with winning the gaming system progressive award.

Figure 5G:
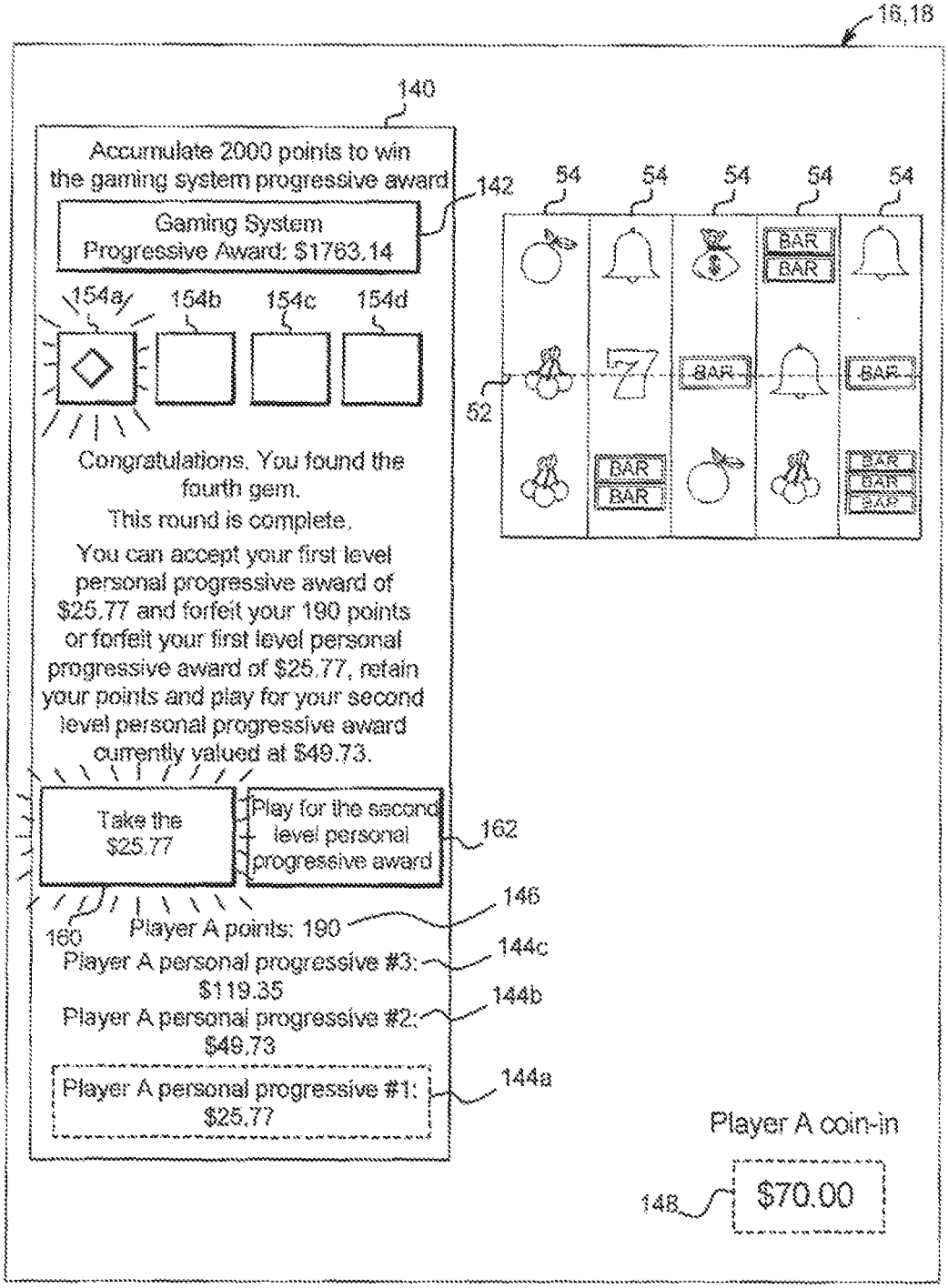
Figure 5H:
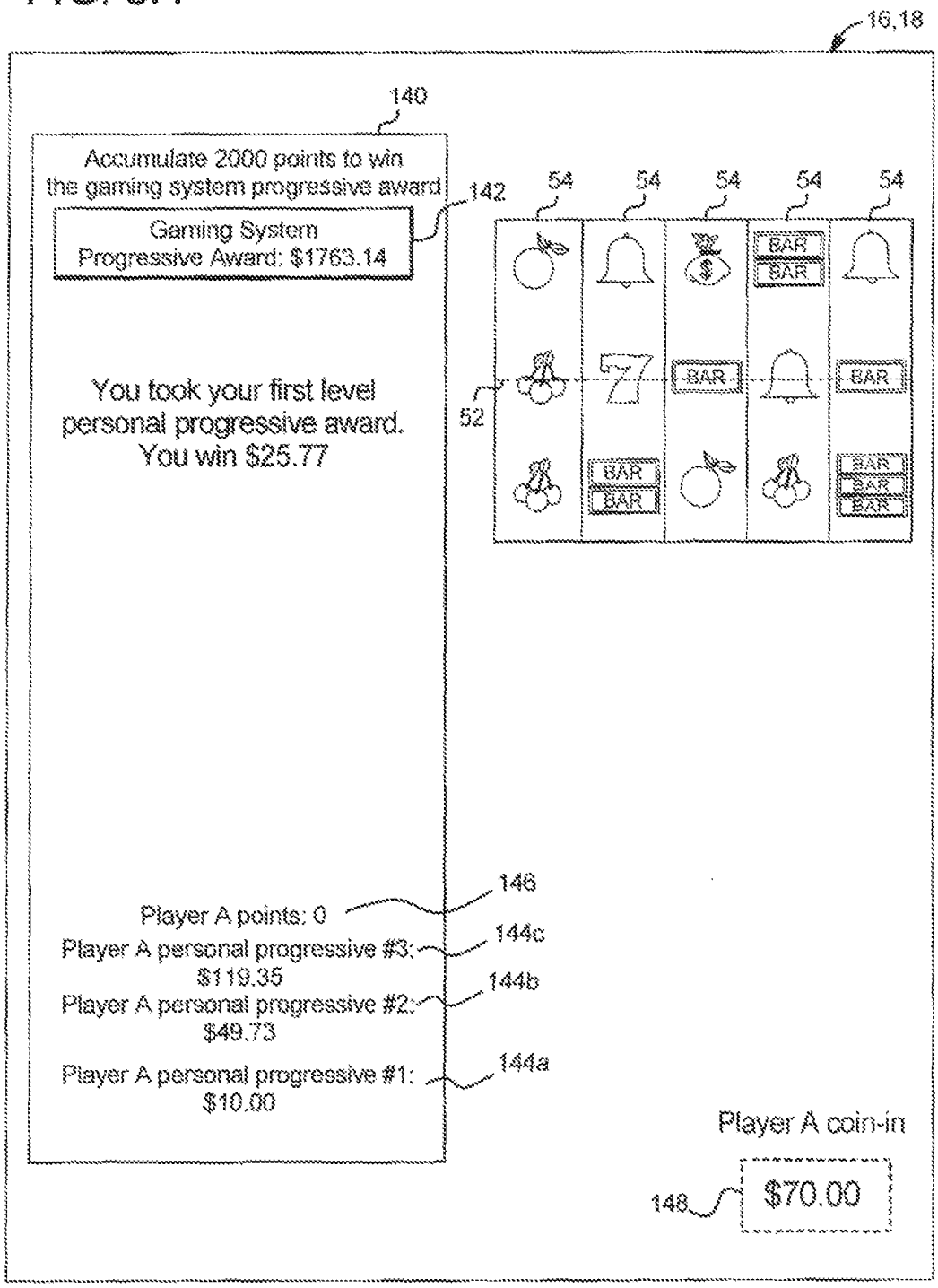

As seen in FIGS. 5G and 5F, if the player accepted the personal progressive award (by utilizing the personal progressive award acceptor 160) the gaming device provides the player the first level personal progressive award 144*a*. In this example embodiment, in addition to providing the player the accepted personal progressive award, as seen in FIG. 5F, the gaming system resets the quantity of accumulated points associated with the player 146 to zero and resets the first level personal progressive award for the player to a reset or base value of $10.00. The gaming device displays appropriate messages such as "YOU TOOK YOUR FIRST LEVEL PERSONAL PROGRESSIVE AWARD" and "YOU WIN $25.77" to the player visually, or through suitable audio or audiovisual displays.

Figure 5I:
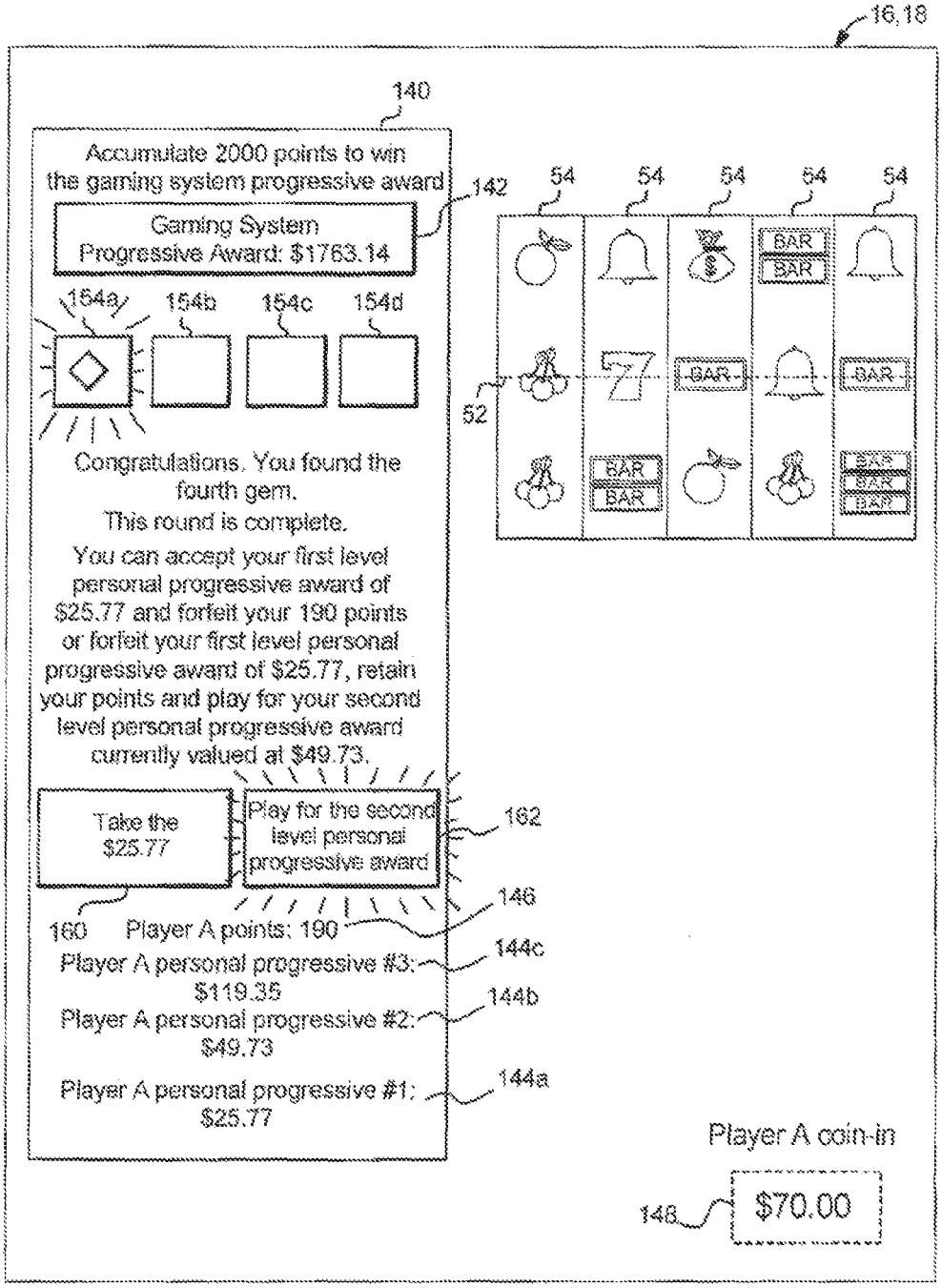
Figure 5J:
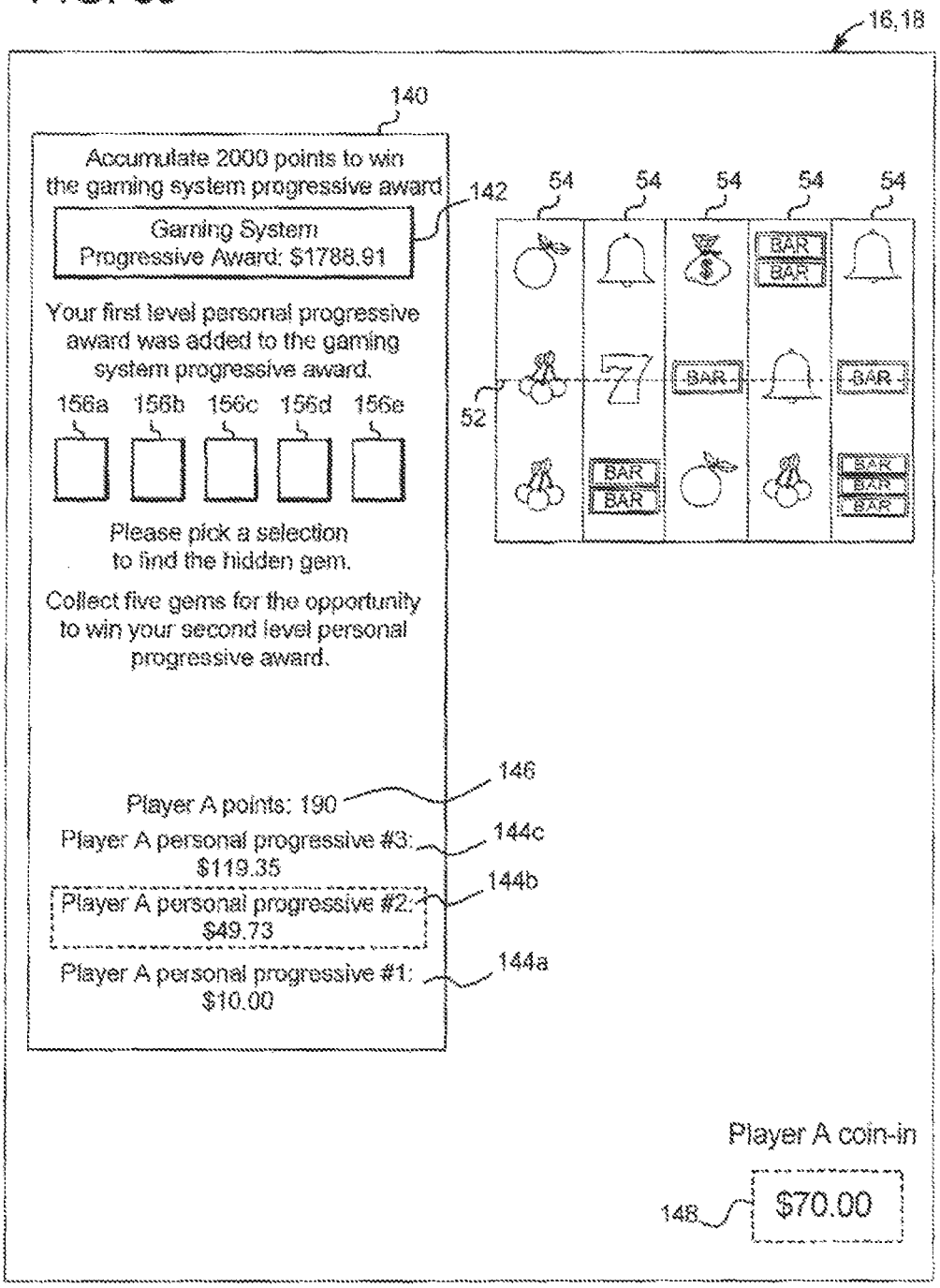

On the other hand, as seen in FIGS. 5I and 5J, if the player rejected the personal progressive award (by utilizing the personal progressive award rejector 162), the gaming device retains the player's quantity of one-hundred-ninety accumulated points 146. In this example embodiment, as seen in FIG. 5J, the gaming system adds the current value of $25.77 of the rejected personal progressive award to the designated or gaming system progressive award to result in an updated value of the designated or gaming system progressive award of $1788.91. In this example embodiment, the gaming system further resets the first level personal progressive award for the player to a reset or base value of $10.00. It should be appreciated that this configuration provides that each level personal progressive award for a given player is funded by that player's coin-in or wagers placed, while the designated gaming system progressive award is funded collectively by all players through the forfeited personal progressive awards.

Either after the player rejected the personal progressive award or upon a subsequent occurrence of a triggering event, the gaming system advances the player to the next level or round of the multi-level progressive award game. In this example, the next level or round of the multi-level progressive award game includes Player A playing for highlighted personal progressive award #2 144*b* currently valued at $49.73. In one such embodiment, this next level or round of the multi-level progressive award game is played similar to the recently completed round or level of the multi-level progressive award game. For example, as illustrated in FIG. 5J, the gaming system displays another plurality of selections 156*a*, 156*b*, 156*c*, 156*d* and 156*e* and enables the player to pick a designated selection from this plurality of selections. The gaming device displays appropriate messages such as "YOUR FIRST LEVEL PERSONAL PROGRESSIVE AWARD WAS ADDED TO THE GAMING SYSTEM PROGRESSIVE AWARD", "PLEASE PICK A SELECTION TO FIND THE HIDDEN GAME" and "COLLECT FIVE GEMS FOR THE OPPORTUNITY TO WIN YOUR SECOND LEVEL PERSONAL PROGRESSIVE AWARD" to the player visually, or through suitable audio or audiovisual displays.

In one embodiment, the player continues advancing through the different rounds or levels of the multi-level progressive award game and decides if they want to keep a personal progressive award (and forfeit any accumulated points) or forfeit the personal progressive award (and retain any accumulated points) at the end of a play of the progressive award game.

In one embodiment, each level or round of the multi-level progressive award game is associated with a greater valued personal progressive award and thus, with each successfully attained level or round of the multi-level progressive award game, the multi-level progressive award game will get progressively harder. In one such embodiment, each level may have a higher number of stages required for completion making it harder to solve. For example, level one may include four stages with four selections, level two may include five stages with five selections, and level three may include seven stages with six selections.

In different embodiments, the number of stages of each round of the multi-level progressive award game is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria. In different embodiment, the number of selections of each round of the multi-level progressive award game is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria It should be appreciated that any suitable primary game or secondary game may be incorporated as the multi-level progressive award game provided to the player. In different embodiments, the multi-level progressive award game may incorporate any of the types of games described herein, as well as any suitable puzzle-type game, any suitable persistence game, any suitable wheel game, any suitable selection game, any suitable offer and acceptance game, any suitable cascading symbols game, any suitable ways to win game, any suitable scatter pay game, any suitable group game or any other suitable type of game. In one embodiment, the gaming system incorporates different games to incorporate into the multi-level progressive award game based on the different level personal progressive award the player is playing for.

In different embodiments, the type of game utilized in the multi-level progressive award game is predetermined, randomly determined, determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria. In different embodiment, the characteristics or features of each provided opportunity to be offered one of the personal progressive awards associated with a specific player is predetermined, randomly determined, determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In one embodiment, the above-described attributes of the multi-level progressive award game are the same for each player. In another embodiment, such above-described attributes of the multi-level progressive award games are different for a plurality of players. In another embodiment, such above-described attributes of the multi-level progressive award games are different for each of plurality of players. In one such embodiment, the attributes of the multi-level progressive award game are based on a specific player's status determined through a player tracking system. For example, a first player associated with a platinum level player tracking status may play a first type of game with a first set of characteristics or features as the multi-level progressive award game and a second player associated with a gold level player tracking status may play a second, different type of game with a second, different set of characteristics or features as the multi-level progressive award game. In these embodiment, the quantity of points provided in such multi-level progressive award games and/or the inputs different players must make to accumulate such points is based, at least in part, on the player's status determined through a player tracking system.

In another embodiment, if the player rejects the played for personal progressive award, part of the value of the rejected personal progressive award is added to the designated or gaming system progressive award and part of the value of the rejected personal progressive award is provided to the player. For example, if a player rejects a personal progressive award of $20, this personal progressive award reset to an appropriate reset value, $15 is added to a designated or gaming system progressive award of $500 to result in an updated designated or gaming system progressive award of $515 and $5 is provided to the player.

In one embodiment, the gaming system maintains one or more personal progressive awards for all carded members of a gaming establishment's player tracking club. In this embodiment, the gaming system enables all carded members to play for one or more of their personal progressive awards (as well as the gaming system progressive award). In another embodiment, the gaming system maintains one or more personal progressive awards for all players currently playing gaming devices in the gaming system (i.e., a player tracking card is not required to play for the gaming system progressive award).

In another embodiment, a players accumulates points based on the percentage of correct choices vs. incorrect choices they made. For instance, a player may accumulate seventy five points, if it took them four chances to get three selections correct. In another embodiment, in addition to accumulating points for the provided opportunities to win personal progressive awards, the gaming system provides players one or more points as part of a promotion, based on any suitable event which occurs in relation to a play of a game at a gaming device, and/or any suitable event which occurs independent of any play of any game at any gaming device. It should be appreciated that accumulated points may be determined and defined by any appropriate algorithm implemented by a gaming system designer.

In one embodiment, more than one of the personal progressive awards of a personal MLP configuration start at the same level, such as $10 and increment or increase until provided to a player. In another embodiment, more than one of the personal progressive awards of a personal MLP configuration start at different levels such as $10, $20, $50 and $100 and increment or increase until provided to a player. In one embodiment, one or more of the personal progressive awards of a personal MLP configuration accumulate, at least in part, based on a small percentage (such as 0.1%) of the amounts wagered by (i.e., the coin-in of) the player associated with that personal progressive award. In one embodiment, the percentage that goes to each personal progressive award of a personal MLP configuration is equal (such as 0.1% to each of four personal progressive awards).

In one embodiment, at least a fraction of this base or reset amount may be funded by the casino by using a starting value higher than zero to make the personal progressive awards attractive even after they are reset. In other embodiments, two or more of the personal progressive awards of a personal MLP configuration may be funded by different percentages. In these embodiments, the central server and/or individual gaming device processor continues to increase the personal progressive awards of a personal MLP configuration until a personal progressive award is provided to a specific player associated with that personal progressive award, at which point the personal progressive is reset and another personal progressive award starts incrementing from the appropriate default personal progressive award level. In another embodiment, one or more personal progressive awards increment a predetermined amount per game played. In one such embodiment, this incremental amount is partially funded by an amount of the wagers placed and is partially funded by an amount provided by a gaming establishment marketing or advertisement department. In different embodiments, the gaming establishment marketing or advertisement department provides a value or amount to the personal progressive award based on matching a percentage of wagers placed, a predetermined amount for each game played, an elapsed period of time, or any other suitable manner.

In another embodiment, two or more of the personal progressive awards of a personal MLP configuration may be funded at different temporal rates. In this embodiment, the different personal progressive awards are incremented or funded in different increments of time wherein until the personal progressive hits, a set amount is added to the personal progressive award at each determined time increment. In another embodiment, two or more of the personal progressive awards may each be incremented or funded based on different incrementing factors or incrementors. In this embodiment, a first of the personal progressive awards may increment each time a first incrementing factor occurs and a second of the personal progressive awards may increment each time a second incrementing factor occurs, wherein the first incrementing factor and the second incrementing factor are different. Examples of incrementing factors could be a symbol-driven trigger in the base game, the player betting a maximum amount, a percentage of possible gaming machines being actively played or in active status, or any other suitable method for defining an incrementor.

In one embodiment, one or more of the personal progressive awards of a personal MLP configuration are funded, at least partially, via a side-bet or side-wager which the player may make (and which may be tracked via a side-bet meter). In one embodiment, one or more of the personal progressive awards are funded with only side-bets or side-wagers placed. In another embodiment, one or more of the personal progressive awards are funded based on player's wagers as described above as well as any side-bets or side-wagers placed. In another embodiment, one or more personal progressive awards are funded, at least partially, via an amount provided by one or more marketing and/or advertising departments, such as a casino's marketing department.

In one embodiment, each of the personal MLP configurations include the same quantity of personal progressive awards. In another embodiment, a plurality of the personal MLP configurations each include a different quantity of personal progressive awards. In different embodiments, the quantity of personal progressive awards in each personal MLP configuration is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In one embodiment, the above-described attributes of the personal progressive awards of a personal MLP configuration (e.g., the starting value, the percentage of wagers placed which fund the personal progressive awards) are the same for each player. In another embodiment, such above-described attributes of the personal progressive awards are different for a plurality of players. In another embodiment, such above-described attributes of the personal progressive awards are different for each of plurality of players. In one such embodiment, the attributes of the personal progressive awards of a personal MLP configuration are based on a specific player's status determined through a player tracking system. For example, one or more of the personal progressive awards associated with a player of platinum level player tracking status may have a default starting value greater than the default starting value of one or more of the personal progressive awards associated with a player of gold level player tracking status. In different embodiments, the attributes associated with one or more of the personal progressive awards associated with one or more players is predetermined, randomly determined, determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In another embodiment, if the triggering event occurs, the gaming system provides a player an opportunity to play for one or more personal, non-progressive awards maintained for that player. In one embodiment, the gaming system maintains at least one personal progressive award for the player and at least one personal, non-progressive award for the player wherein if the triggering event occurs, the gaming system provides the player an opportunity to play for one of these maintained personal awards. In different embodiments, which personal award (i.e., a personal progressive award or a personal, non-progressive award) the gaming system enables a player to play for is based on the level of the multi-level progressive award game, predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In one embodiment, if the triggering event which provides a player an opportunity to play for one of the personal progressive awards maintained for that player occurs, the gaming system enables the player to defer or delay their participation in such an opportunity. In this embodiment, the gaming system enables the player to escrow or save their plays for a personal progressive award, wherein the gaming system enables the player to participate in a plurality of opportunities for one or more personal progressive awards at one time. For example, if a triggering event which provides a player an opportunity to play for one of the personal progressive awards maintained for that player occurs once for every $10 wagered by a player, then a player who wagers $60 may play participate in one opportunity to win a personal progressive award after each $10 wagered or save these opportunities and participate in six sequential opportunities to win one or more personal progressive awards.

In another embodiment, stored opportunities to win one or more personal progressive awards are associated with a time period for usage. Such stored opportunities to win one or more personal progressive awards may be associated with a time of day, certain day(s) of week, a month and/or a year which they can be used. In one such embodiment, the central server excludes the player from playing a stored opportunity to win a personal progressive awards during certain days and times. For example, a player's previously stored opportunities to win one or more personal progressive awards are available for play every day in July from 8:00 am to 5:00 pm except July 4.

In another embodiment, opportunities to win one or more personal progressive awards are associated with an expiration date and time. In this embodiment, the gaming system/gaming device is configured to communicate to the player the proximity of the expiration of any stored opportunities to win one or more personal progressive awards (i.e., "your opportunity to win a personal progressive award will expire at 6:00 am tomorrow"). In one embodiment, such notice of expiration of a stored opportunity to win a personal progressive award is at the player's currently played gaming device. In another embodiment, such notice of expiration of a stored opportunity to win a personal progressive award is external from the player's currently played gaming device, such as via e-mail. In different embodiments, if multiple opportunities to win one or more personal progressive awards are stored in associated with a player's account, the presentation of stored opportunities to win one or more personal progressive awards are provided to the player in order of expiration (first to expire shows first), in order of first earned basis.

In another embodiment, one or more personal progressive awards associated with one or more players are associated with an expiration date and time. In this embodiment, the gaming system/gaming device is configured to communicate to the player the proximity of the expiration of any personal progressive awards. In one embodiment, such notice of expiration of a personal progressive award is at the player's currently played gaming device. In another embodiment, such notice of expiration of a personal progressive award is external from the player's currently played gaming device, such as via e-mail. In one such embodiment, the value of any personal progressive awards which expire are added to the value of one or more gaming system or designated progressive awards.

In another embodiment, the gaming system enables a player to convert an offered personal progressive award to a quantity of points to accumulate. In one such embodiment, the gaming system converts the value of the offered personal progressive award (or a designated value based on the value of the offered personal progressive award) to a quantity of points to accumulate. In different embodiments, the quantity of points to accumulate provided in return for a personal progressive award is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In another embodiment, if the player accumulated the designated number of points associated with the gaming system progressive award, the gaming system provides the player a portion of the gaming system progressive award. In this embodiment, the portion of the gaming system progressive award provided to the player is based on the player's accumulated points relative to the total number of outstanding points accumulated by players at the gaming devices in the gaming system.

In an alternative embodiment, the triggering event which provides a player an opportunity to play for one of the personal progressive awards maintained for that player occurs based on a predefined variable reaching a defined parameter threshold. For example, when the 500,000$^{th}$ player has played a gaming machine of the gaming system (ascertained from a player tracking system), such a triggering event occurs. In different embodiments, the predefined parameter thresholds include a length of time, a length of time after a certain dollar amount is hit, a wager level threshold for a specific machine (which gaming device is the first to contribute $250,000), a number of gaming machines active, or any other parameter that defines a suitable threshold.

In another embodiment, the triggering event which provides a player an opportunity to play for one of the personal progressive awards maintained for that player occurs based on time. In this embodiment, a time is set for when such a triggering event will occur. In one embodiment, such a set time is based on historic data.

In another embodiment, the triggering event which provides a player an opportunity to play for one of the personal progressive awards maintained for that player occurs based upon gaming system operator defined player eligibility parameters stored on a player tracking system (such as via a player tracking card or other suitable manner). In this embodiment, the parameters for eligibility are defined by the gaming system operator based on any suitable criterion. In one embodiment, the central controller/gaming device processor recognizes the player's identification (via the player tracking system) when the player inserts or otherwise associates their player tracking card in the gaming machine. The central server/gaming device processor determines the player tracking level of the player and if the current player tracking level defined by the gaming system operator is eligible to play for one of the personal progressive awards associated with that player. In one embodiment, the gaming system operator defines minimum bet levels required for the triggering event to occur based on the player's card level.

In another embodiment, the triggering event which provides a player an opportunity to play for one of the personal progressive awards maintained for that player occurs based on a system determination, wherein the triggering event occurs due to a random selection by the central controller. In one embodiment, the central controller tracks all active gaming machines and the wagers they placed. Each gaming machine has its own entry defining its state as either active or inactive and also defining the values of the wagers from that gaming machine. In one embodiment, active status means that the gaming machine is being actively played by a player and enrolled/inactive status means that the gaming machine is not being actively played by a player. The active status requirements can be based on any suitable number of satisfied criteria or defined in any suitable manner by the implementer of the gaming system. For instance, a play of or wager on the primary game of the gaming machine within a predetermined period of time may be part of the determination of whether that gaming machine is in the active status. Other factors such as: (a) the amount of time between each play of or wager on the primary game of the gaming machine; (b) the amount being wagered on the primary game(s); and (c) the number of plays within a period of time, may also or alternatively be part of the determination of whether a gaming machine is in the active status. On the other hand, inactive status means that the gaming machine is one of the gaming machines in the gaming system, but is not in the active status (i.e., not being actively played by a player according to one or more of the predetermined criteria). In one such embodiment, based on the gaming machine's state as well as one or more wager pools associated with the gaming machine, the central controller determines whether the triggering event occurs in association with that player. In one such embodiment, the player who consistently places a higher wager is more likely to cause a triggering event to occur than a player who consistently places a minimum wager.

In another embodiment, the triggering event which provides a player an opportunity to play for one of the personal progressive awards maintained for that player occurs by determining if any numbers allotted to a gaming device match a randomly selected number. In this embodiment, upon or prior to each play of each gaming machine, a gaming device selects a random number from a range of numbers and during each primary game, the gaming machine allocates the first N numbers in the range, where N is the number of credits bet by the player in that primary game. At the end of the primary game, the randomly selected number is compared with the numbers allocated to the player and if a match occurs, such a triggering event occurs for the player at that particular gaming machine. It should be appreciated that any suitable manner of causing a triggering event to occur may be implemented in accordance with the gaming system and method disclosed herein.

In one embodiment, in addition to providing one or more personal progressive awards and/or designated or gaming system progressive awards as described above, a plurality of gaming devices at one or more gaming sites are networked to the central server in a progressive configuration, wherein a portion of each wager placed is allocated to one or more progressive awards. In one embodiment, such progressive awards are associated with the system of gaming machines which each contribute portions of the progressive awards. In one such embodiment, different progressive awards are associated with different numbers of gaming devices. For example, a progressive award valued at $10,000 may be associated with ten gaming devices while another progressive award valued at $500,000 may be associated with one-hundred gaming devices. In one embodiment, the multiple gaming machines may be in the same bank of machines, in the same casino or gaming establishment such as through a LAN or in two or more different casinos or gaming establishments such as through a WAN. In another embodiment, each individual gaming machine maintains one or more progressive awards wherein a portion of each wager placed at that respective gaming machine is allocated to one or more progressive awards maintained by such individual gaming machine. In another embodiment, each individual gaming machine maintains one or more progressive awards and the central server simultaneously or substantially simultaneously maintains one or more progressive awards. In one such embodiment, the lower valued, more frequently triggered progressive awards are maintained by the individual gaming machines and the higher valued, less frequently triggered progressive awards are maintained by the central server.

In one embodiment, a host site computer is coupled to a plurality of the central servers at a variety of mutually remote gaming sites for providing a multi-site linked progressive automated gaming system. In one embodiment, a host site computer may serve gaming devices distributed throughout a number of properties at different geographical locations including, for example, different locations within a city or different cities within a state. In one embodiment, the host site computer is maintained for the overall operation and control of the system. In this embodiment, a host site computer oversees all or part of the progressive gaming system and is the master for computing all or part of the progressive jackpots. All participating gaming sites report to, and receive information from, the host site computer. Each central server computer is responsible for all data communication between the gaming device hardware and software and the host site computer.

In one embodiment, more than one of the progressive awards start at the same level, such as $1000 and increment or increase until provided to a player. In another embodiment, more than one of the progressive awards start at different levels such as $10, $100, $1000 and $10,000 and increment or increase until provided to a player. The progressive awards accumulate based on a small percentage (such as 0.1%) of coin-in or wagered amounts in a conventional manner. In one embodiment, the percentage that goes to each progressive award is equal (such as 0.1% to each of four progressive awards). At this accrual rate, player wagers totaling $1,000,000 are required for the progressive to reach $1000. In one embodiment, at least a fraction of this amount may be funded by the casino by using a starting value higher than zero to make the progressive awards attractive even after they are reset. In other embodiments, two or more of the progressive awards may be funded by different percentages. In these embodiments, the central server and/or individual gaming device processor continues to increase the progressive levels until a progressive award is provided to a player (upon the occurrence of a progressive award triggering event), at which point the progressive is reset and another progressive award starts incrementing from the appropriate default progressive award level. In another embodiment, one or more progressive awards increment a predetermined amount per game played. In one such embodiment, this incremental amount is partially funded by an amount of the wagers placed and is partially funded by an amount provided by a gaming establishment marketing or advertisement department. In different embodiments, the gaming establishment marketing or advertisement department provides a value or amount to the progressive award based on matching a percentage of wagers placed, a predetermined amount for each game played, an elapsed period of time, or any other suitable manner.

In another embodiment, two or more of the progressive awards may be funded at different temporal rates. In this embodiment, the different progressive awards are incremented or funded in different increments of time wherein until the progressive hits, a set amount is added to the progressive at each determined time increment. In another embodiment, two or more of the progressive awards may each be incremented or funded based on different incrementing factors or incrementors. In this embodiment, a first of the progressive awards may increment each time a first incrementing factor occurs and a second of the progressive awards may increment each time a second incrementing factor occurs, wherein the first incrementing factor and the second incrementing factor are different. Examples of incrementing factors could be a symbol-driven trigger in the base game, the player betting a maximum amount, a percentage of possible gaming machines being actively played or in active status, or any other suitable method for defining an incrementor.

In one embodiment, one or more of the progressive awards are funded, at least partially, via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed. In another embodiment, one or more progressive awards are funded, at least partially, via an amount provided by one or more marketing and/or advertising departments, such as a casino's marketing department.

In one alternative embodiment, a minimum wager level is required for a gaming machine to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In one embodiment, the central server or other central controller determines when one or more progressive award wins are triggered. In this embodiment, a central controller and an individual gaming machine work in conjunction with each other to determine when a progressive award win is triggered, for example through an individual gaming machine meeting a predetermined requirement or criteria established by the central controller. In another embodiment, an individual gaming machine may determine when one or more progressive award wins are triggered. In another embodiment, an individual gaming machine may determine when at least one progressive award win is triggered and the central controller determines when at least one progressive award win is triggered.

In one embodiment, different gaming devices in the gaming system have different progressive awards available to a player. In one such embodiment, different types of gaming devices are associated with different types of progressive awards based on the current configuration of the gaming system. In one embodiment, zero, one or more progressive awards may be associated with each of the gaming devices in the gaming system while zero, one or more different progressive awards may be associated with a plurality of, but not all of the gaming devices in the gaming system.

In one embodiment, at least one and preferably a plurality of the progressive awards maintained by the gaming system are provided to players of the linked gaming machines in an apparently random fashion as perceived by the players of these gaming machines. These progressive awards are distinguished from the awards that the gaming machines provide to the players for displayed winning outcomes in the plays of the primary wagering games, such as slot games, card games (e.g., poker, blackjack) or any other suitable game.

In one embodiment, the gaming devices do not provide any apparent reasons to the players for obtaining such progressive awards. In this embodiment, providing the progressive awards is not triggered by a displayed event in the primary game or based specifically on any of the plays of any primary game or on any of the plays of any secondary game of the gaming machines in the system. That is, these progressive awards are provided to the players without any explanation or alternatively with simple explanations.

Information Provided to Player

As indicated above, the progressive awards and/or personal progressive awards may be provided to the players of the gaming machines with or without explanation or information provided to the player, or alternatively information can be displayed to the player. In one embodiment, suitable information about these progressive awards can be provided to the players through one or more displays on the gaming machines or additional information displays positioned near the gaming machines, such as above a bank of system gaming machines.

This information can be used to entertain the player or inform the player that a progressive award triggering event has occurred or will occur. Examples of such information are:

(1) that a triggering event has occurred;

(2) that a triggering event will shortly occur (i.e., foreshadowing the possible providing of a progressive award or a personal progressive award);

(3) that one or more progressive awards or personal progressive awards have been provided to one or more players of the system gaming machines;

(4) which gaming machines have won the progressive awards or personal progressive awards;

(5) the amount of the progressive awards or personal progressive awards won;

(6) the highest progressive award or personal progressive award won;

(7) the lowest progressive award or personal progressive award won;

(8) the average progressive award or personal progressive award won;

(9) number of games played/total time since the last progressive award or personal progressive award was won;

(10) the average time between progressive awards or personal progressive awards being hit;

(11) the number of progressive awards or personal progressive awards won in a designated time period; and

(12) the amount of the progressive awards or personal progressive awards that can be won.

It should be appreciated that such information can be provided to the players through any suitable audio, audio-visual or visual devices.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming system comprising:

a plurality of gaming devices, each gaming device including:

(i) at least one display device, and (ii) at least one input device; and at least one controller configured to operate with each of said gaming devices to:

(a) for each of at least one of a plurality of players of said plurality of gaming devices, maintain a personal award, (b) maintain at least one non-personal award, (c) if a non-personal award equity accumulation event occurs, cause at least one of the players to accumulate an amount of equity in the at least one non-personal award, and (d) if a designated event occurs:

(i) for at least one of the players:

(A) enable the player to accept or reject the personal award maintained for the player, (B) if the player accepts the personal award maintained for the player:

(I) provide the player the personal award maintained for the player, and (II) cause the player to forfeit any amount of accumulated equity in the at least one non-personal award, and (C) if the player rejects the personal award maintained for the player:

(I) cause the player to forfeit the personal award maintained for the player, and (II) cause the player to retain any amount of accumulated equity in the at least one non-personal award.

2. The gaming system of claim 1, wherein for at least one of the players, said personal award maintained for said player is configured to be provided to said player and not configured to be provided to any other of the plurality of players.

3. The gaming system of claim 1, wherein the personal award maintained for one of the players is a personal progressive award funded, at least in part, based on wagers placed by the player on any plays of any games at any of said gaming devices.

4. The gaming system of claim 1, wherein the at least one non-personal award is a progressive award funded, at least in part, based on wagers placed by each of the players on any plays of any games at any of said gaming devices.

5. The gaming system of claim 1, wherein the at least one controller configured to operate with each of said gaming devices to add said personal award maintained for the player to the at least one non-personal award if the player rejects the personal award maintained for the player.

6. The gaming system of claim 1, wherein the designated event occurs based on at least one input by at least one of the players.

7. The gaming system of claim 1, wherein the designated event occurs independent of any displayed events in any plays of any games of the gaming devices.

8. The gaming system of claim 1, wherein at least one of: (i) at least one of the personal awards maintained for at least one of the plurality of players and (ii) the at least one non-personal award, includes an amount of non-monetary credits.

9. A method of operating a gaming system, said method comprising:

(a) for each of at least one of a plurality of players of a plurality of gaming devices, causing at least one controller to maintain a personal award, (b) causing the at least one controller to maintain at least one non-personal award, (c) if a non-personal award equity accumulation event occurs, causing the at least one controller to cause at least one of the players to accumulate an amount of equity in the at least one non-personal award, and (d) if a designated event occurs:

(i) for at least one of the players:

(A) enabling the player to accept or reject the personal award maintained for the player, (B) if the player accepts the personal award maintained for the player:

(I) providing the player the personal award maintained for the player, and (II) causing the at least one controller to cause the player to forfeit any amount of accumulated equity in the at least one non-personal award, and (C) if the player rejects the personal award maintained for the player:

(I) causing the at least one controller to cause the player to forfeit the personal award maintained for the player, and (II) causing the at least one controller to cause the player to retain any amount of accumulated equity in the at least one non-personal award.

10. The method of claim 9, wherein for at least one of the players, said personal award maintained for said player is configured to be provided to said player and not configured to be provided to any other of the plurality of players.

11. The method of claim 9, wherein the personal award maintained for one of the players is a personal progressive award funded, at least in part, based on wagers placed by the player on any plays of any games at any of said gaming devices.

12. The method of claim 9, wherein the at least one non-personal award is a progressive award funded, at least in part, based on wagers placed by each of the players on any plays of any games at any of said gaming devices.

13. The method of claim 9, which includes causing the at least one controller to add said personal award maintained for the player to the at least one non-personal award if the player rejects the personal award maintained for the player.

14. The method of claim 9, wherein the designated event occurs based on at least one input by at least one of the players.

15. The method of claim 9, wherein the designated event occurs independent of any displayed events in any plays of any games of the gaming devices.

16. The method of claim 9, wherein at least one of: (i) at least one of the personal awards maintained for at least one of the plurality of players and (ii) the at least one non-personal award, includes an amount of non-monetary credits.

17. The method of claim 9, which is provided through a data network.

18. The method of claim 17, wherein the data network is an internet.

* * * * *

UNITED STATES PATENT AND TRADEMARK OFFICE

CERTIFICATE OF CORRECTION

PATENT NO. : 8,517,828 B2
APPLICATION NO. : 13/443578
DATED : August 27, 2013
INVENTOR(S) : Daniel Dewaal et al.

It is certified that error appears in the above-identified patent and that said Letters Patent is hereby corrected as shown below:

IN THE CLAIMS

In Claim 5, Column 42, Line 52, between “controller” and “configured” insert --is--.

Signed and Sealed this
Thirteenth Day of January, 2015

Michelle K. Lee

Michelle K. Lee
*Deputy Director of the United States Patent and Trademark Office*